US010570651B2

(12) United States Patent
Ueda et al.

(10) Patent No.: US 10,570,651 B2
(45) Date of Patent: Feb. 25, 2020

(54) PLUG DOOR LOCK DEVICE AND PLUG DOOR SYSTEM

(71) Applicant: NABTESCO CORPORATION, Tokyo (JP)

(72) Inventors: Shinji Ueda, Hyogo (JP); Atsuhito Yamaguchi, Hyogo (JP); Genta Sakaki, Hyogo (JP)

(73) Assignee: NABTESCO CORPORATION, Tokyo (JP)

( * ) Notice: Subject to any disclaimer, the term of this patent is extended or adjusted under 35 U.S.C. 154(b) by 746 days.

(21) Appl. No.: 14/580,936

(22) Filed: Dec. 23, 2014

(65) Prior Publication Data

US 2015/0184433 A1 Jul. 2, 2015

(30) Foreign Application Priority Data

Dec. 26, 2013 (JP) ..... 2013-269402

(51) Int. Cl.
*E05B 85/20* (2014.01)
*E05B 83/40* (2014.01)
(Continued)

(52) U.S. Cl.
CPC ..... *E05B 85/20* (2013.01); *E05B 81/20* (2013.01); *E05B 83/363* (2013.01); *E05B 83/40* (2013.01);
(Continued)

(58) Field of Classification Search
CPC ..... E05B 43/005; E05B 47/0001; E05B 47/0012; E05B 17/0029; E05B 81/20; E05B 81/06; E05B 81/16; E05B 81/34; E05B 83/02; E05B 83/04; E05B 83/06; E05B 83/363; E05B 83/40; E05B 85/243; E05B 85/20; Y10T 292/0803; Y10T 292/0848;
(Continued)

(56) References Cited

U.S. PATENT DOCUMENTS 4,056,276 A * 11/1977 Jarvis ..... E05B 47/06 292/117
2010/0319261 A1* 12/2010 Beck ..... E05B 81/06 49/334
(Continued)

FOREIGN PATENT DOCUMENTS

CN 201695839 U 1/2011
CN 103415668 A 11/2013
(Continued)

OTHER PUBLICATIONS

Office Action as issued in Japanese Patent Application No. JP 2014-254772, dated Aug. 25, 2015.
(Continued)

*Primary Examiner* — Christine M Mills
(74) *Attorney, Agent, or Firm* — Pillsbury Winthrop Shaw Pittman, LLP

(57) ABSTRACT

The plug door lock device is provided with a plurality of lock mechanisms, each of which has a motor for locking the door leaf. Each of the lock mechanisms has a lock arm capable of coming into engagement with an engaged portion fixed to the door leaf, a link member having one end-side portion coupled rotatably to the lock arm and a rotation preventing mechanism.

10 Claims, 13 Drawing Sheets

(51) Int. Cl.

| | |
|---|---|
| ***E05B 81/20*** | (2014.01) |
| ***E05B 83/36*** | (2014.01) |
| *E05B 81/06* | (2014.01) |
| *E05B 81/34* | (2014.01) |

(52) U.S. Cl.
CPC ..... *E05B 81/06* (2013.01); *E05B 81/34* (2013.01); *Y10T 292/1082* (2015.04)

(58) Field of Classification Search
CPC ..... Y10T 292/0849; Y10T 292/0852; Y10T 292/0856; Y10T 292/1045; Y10T 292/1082; Y10T 292/1079; Y10T 292/307; Y10T 292/308; Y10S 292/25; Y10S 292/32
USPC .. 292/5, 44, 45, 47, 51, 214, 201, 199, 279, 292/280, DIG. 25, DIG. 32
See application file for complete search history.

(56) References Cited

U.S. PATENT DOCUMENTS

| | | | |
|---|---|---|---|
| 2013/0234448 | A1 | 9/2013 | Beck et al. |
| 2014/0020299 | A1 | 1/2014 | Takahashi et al. |
| 2015/0145264 | A1 | 5/2015 | Takahashi et al. |

FOREIGN PATENT DOCUMENTS

| | | | | |
|---|---|---|---|---|
| DE | 3150621 | A1 * | 6/1983 | ..... E05B 81/06 |
| DE | 19944615 | A1 * | 4/2001 | ..... B60J 7/198 |
| EP | 1637675 | A1 | 3/2006 | |
| FR | 2772063 | A1 | 6/1999 | |
| JP | 06-262945 | A | 9/1994 | |
| JP | H07-047387 | B2 | 5/1995 | |
| JP | 2005-061065 | A | 3/2005 | |
| JP | 2008-190199 | A | 8/2008 | |
| KR | 10-2013-0106137 | A | 9/2013 | |
| WO | 2009042992 | A1 | 4/2009 | |

OTHER PUBLICATIONS

First Office Action as issued in Chinese Patent Application No. 201410831939.2, dated Aug. 1, 2016.
Notification of Reasons for Refusal as issued in Japanese Patent Application No. 2014-254772, dated Feb. 2, 2016,.
Office Action French Patent Application No. 1463314 dated Jun. 29, 2018 with English translation.

* cited by examiner

PLUG DOOR LOCK DEVICE AND PLUG DOOR SYSTEM

TECHNICAL FIELD

The present invention relates to a plug door lock device for locking a plug door of a vehicle, and a plug door system having this device.

BACKGROUND ART

A plug door installed in a doorway of a vehicle has conventionally been known. Such a plug door executes a plug operation in which, after moving in the closing direction to cover the doorway, the plug door moves toward the inside of the vehicle in the vehicle width direction to bring the doorway and the door leaf into tight contact with each other.

A plug door lock device for mechanically locking the door leaf to the vehicle subsequent to the plug operation is mounted in the plug door described above. Japanese Unexamined Patent Publication No. H06-262945, for example, discloses a plug door device (plug door lock device) that has lock arms provided on the upper and lower sides of the door leaf. When a motor is driven in this plug door lock device, a latching roller provided at a tip end part of each lock arm fits into a groove of a latching opening formed on the door (door leaf). The lock arms therefore pull the door leaf toward the vehicle. Consequently, as a result of the plug operation of the door leaf, the space between the doorway of the vehicle and the door leaf is kept airtight. In this airtight state, the door leaf is locked to the vehicle.

Incidentally, the plug door lock device described above is provided with a universal joint for the purpose of operating the two lock arms on the upper and lower sides of the door leaf by means of a single motor. For this reason, the plug door lock device has a complicated structure. In addition, in case of failure in the motor, the failure has an impact on both of the two lock arms.

SUMMARY OF INVENTION

An object of the present invention is to improve the safety of a plug door by a simplified structure.

A plug door lock device according to a certain aspect of the present invention is a plug door lock device that is installed in a vehicle and locks, with respect to the vehicle, a door leaf (2) that executes an opening/closing operation for opening/closing a doorway by moving in a front-back direction of the vehicle and a plug operation for coming into contact with or separating from the vehicle by moving in a width direction of the vehicle, wherein the plug door lock device is provided with a plurality of lock mechanisms (5), each of which has a motor for locking the door leaf (2).

DESCRIPTION OF EMBODIMENTS

An embodiment for implementing the present invention is described hereinafter with reference to the drawings. The present invention can be applied as a plug door lock device for mechanically locking a plug-type door (plug door) installed in a doorway of a railroad vehicle, and a plug door system having the plug door lock device.

[Overall Configuration of the Plug Door System]

Figure 1:
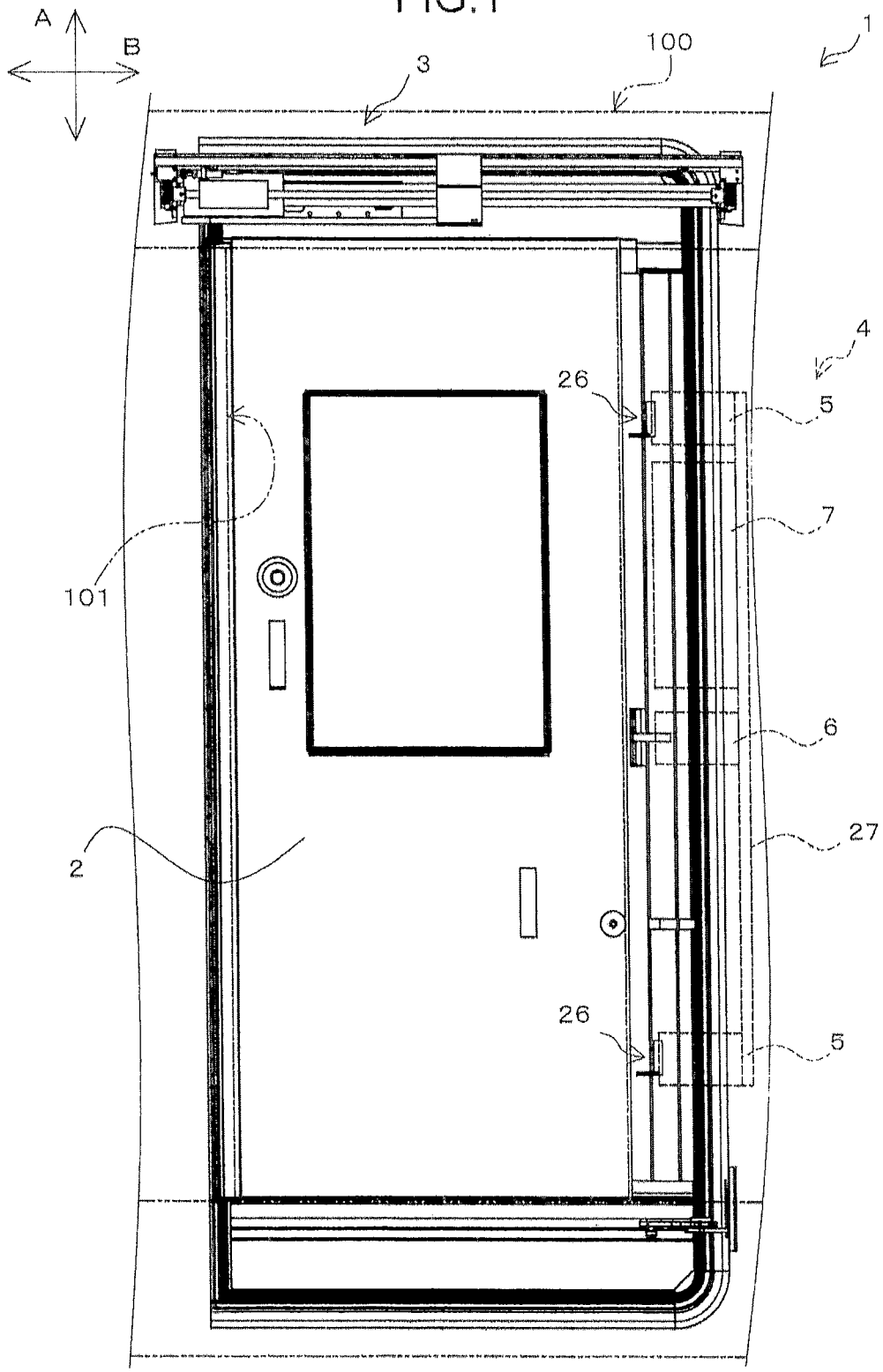
FIG. 1 is a schematic diagram showing a plug door system according to an embodiment of the present invention, in which the plug door system is viewed from the inside of a vehicle.
Figure 2:
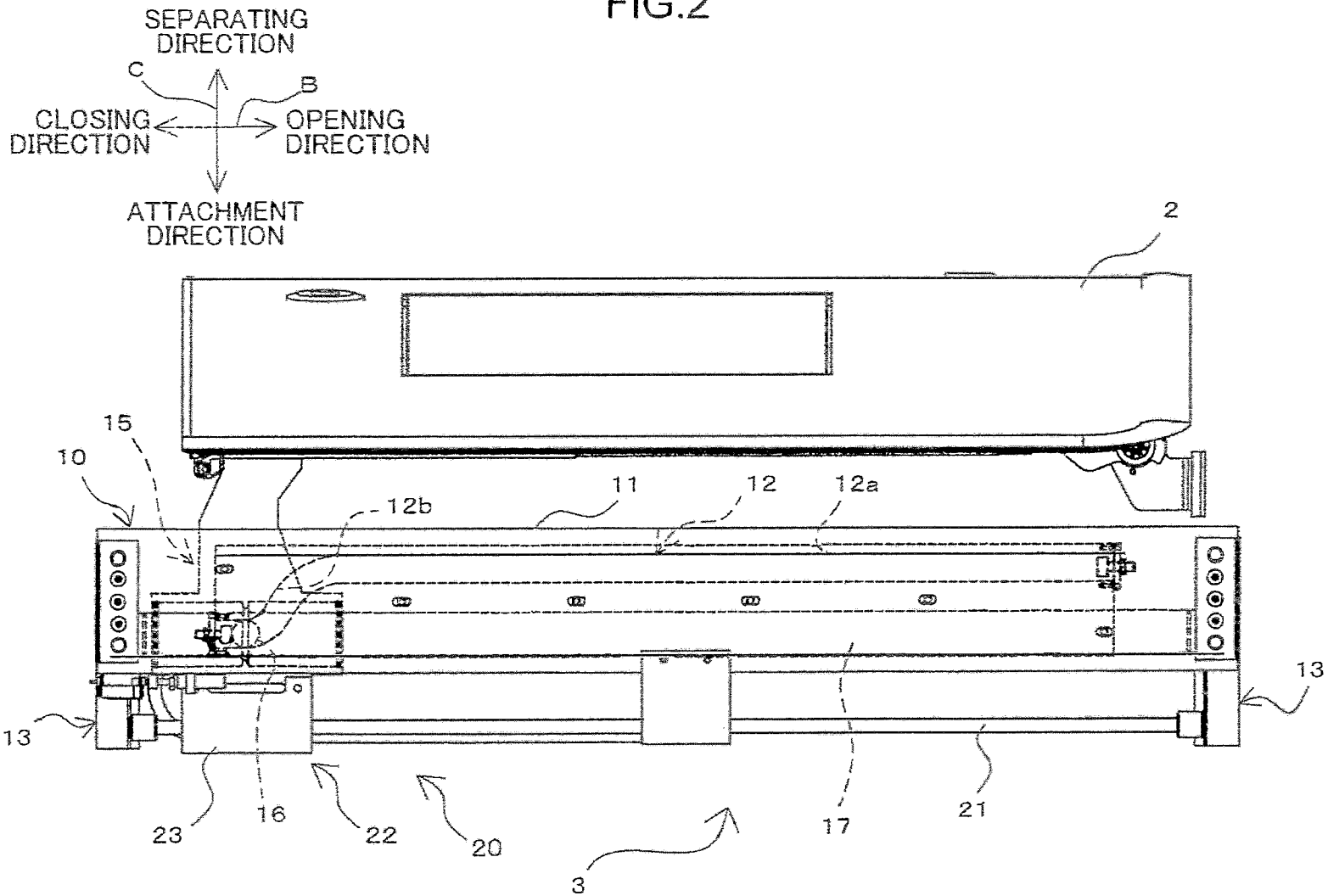
FIG. 2 is a schematic diagram showing a plug door and door drive unit of FIG. 1 from above.
Figure 3:
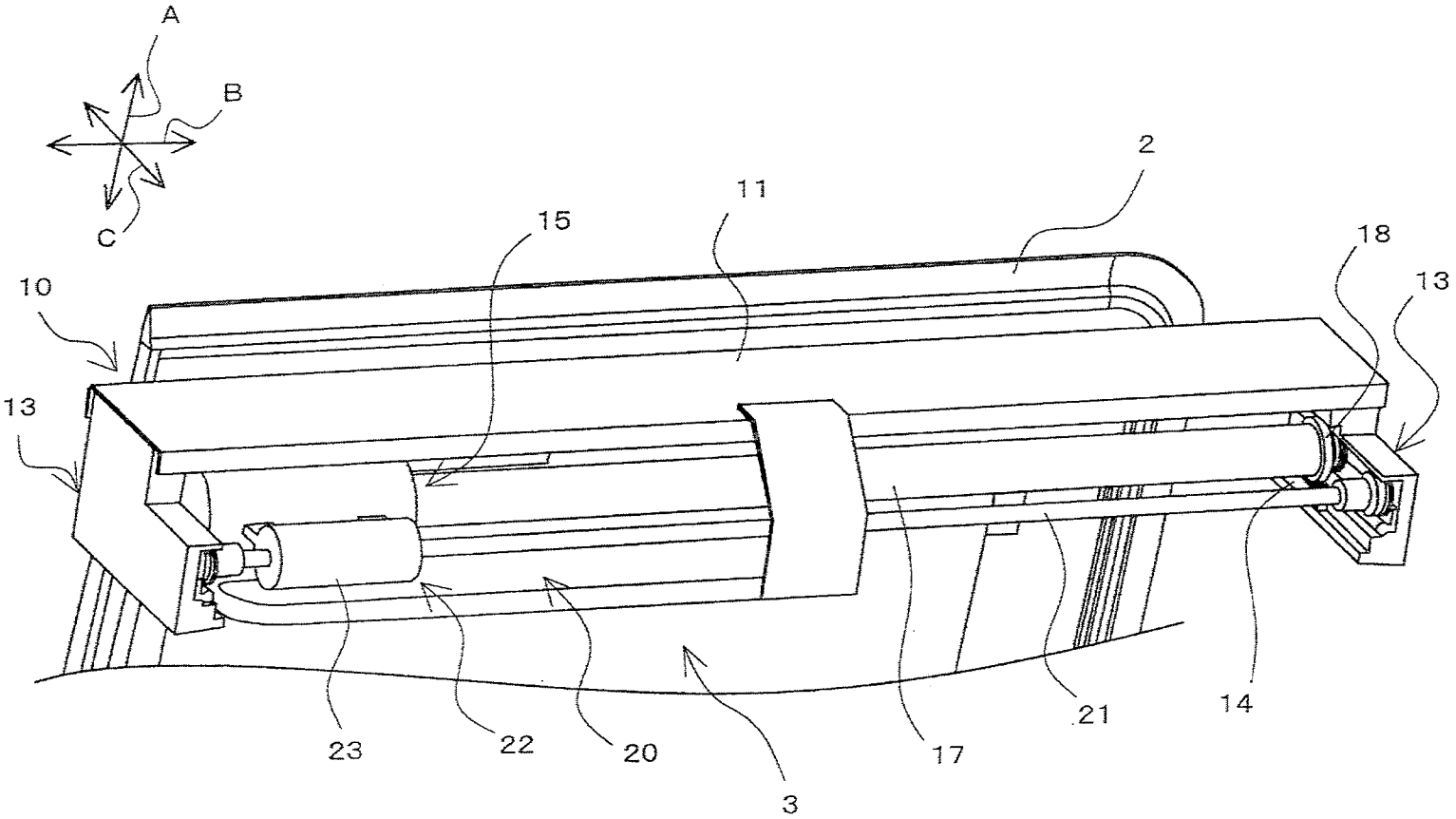
FIG. 3 is a schematic diagram showing part of the plug door and the door drive unit of FIG. 1 from obliquely above.

FIG. 1 is a schematic diagram showing a schematic configuration of a plug door system 1 according to an embodiment of the present invention, in which the plug door system 1 is viewed from the inside of a vehicle 100. FIG. 2 is a schematic diagram showing a plug door 2 and a door drive unit 3 from above. FIG. 3 is a schematic diagram showing part of the plug door 2 and the door drive unit 3 from obliquely above.

As shown in FIG. 1, the plug door system 1 has the plug door 2, the door drive unit 3, and a lock device 4 (plug door lock device). In FIG. 1, the position of the lock device 4 in relation to the plug door 2 is schematically shown by dashed lines. In FIGS. 1 to 3, the direction shown by the arrow A represents the vertical direction of the vehicle 100, the direction shown by the arrow B the front-back direction of the vehicle 100, and the direction shown by the arrow C the width direction (vehicle width direction) of the vehicle 100.

The plug door 2 is a door leaf provided in the vehicle (railroad vehicle) 100. As shown in FIG. 1, the plug door 2 is in a substantially rectangular shape elongated in the vertical direction A as viewed planarly. Although not shown, the plug door 2 has its lower part in the vertical direction A protruding slightly outward in the vehicle width direction C, when viewed in the front-back direction B. Locking bolts 26 (engaged portions) are fixed to part of the plug door 2 on the inside of the vehicle. The locking bolts 26 are provided in upper and lower sections on the door tail side of the plug door 2 respectively. The locking bolts 26 are in the shape of a cylindrical rod and installed integrally with the plug door 2, with the axial centers of the locking bolts 26 aligned in the vertical direction.

The plug door 2 can be moved with respect to the vehicle 100 by the door drive unit 3, which is described hereinafter in detail. Specifically, the plug door 2 opens/closes a doorway 101 by executing an opening/closing operation for moving in the front-back direction B of the vehicle 100. The plug door 2 also executes a plug operation for moving in the vehicle width direction C. More specifically, the plug door 2 executes an attachment operation to be attached to the doorway 101 by moving towards the inside of the vehicle in the vehicle width direction C, and a separation operation for separating from the doorway 101 by moving towards the outside of the vehicle in the vehicle width direction C.

The door drive unit 3 has a vehicle-side fixed portion 10 fixed to the vehicle 100, a door-side fixed portion 15 fixed to the plug door 2, a guide member 17, and a door drive mechanism 20, as shown in FIGS. 2 and 3.

The vehicle-side fixed portion 10 has a base portion 11 that is provided above the plug door 2 of the vehicle 100 so as to extend in the front-back direction along the horizontal plane, and a guide frame 13 that is fixed to each end portion of the base portion 11 in the front-back direction. A guiderail 12 is formed on a lower surface of the base portion 11. The guiderail 12 is configured by a straight rail portion 12*a* extending linearly in the front-back direction, and a curved rail portion 12*b* that continues to the straight rail portion 12*a* and curves therefrom towards the inside of the vehicle.

The door-side fixed portion 15 is fixed to the plug door 2 by bolts or the like, with the guide member 17 inserted therein. A guide roller 16 inserted into the guiderail 12 and capable of moving along the guiderail 12 is provided above the door-side fixed portion 15.

The guide member 17 is formed into substantially a pipe elongated in the front-back direction. The guide member 17 has a pinion gear portion 18 formed on each end portion thereof, the pinion gear portions 18 being engaged with the rack gear 14 formed in each guide frame 13.

The door drive mechanism 20 is provided as a drive source for causing the plug door 2 to execute the opening/closing operation and the plug operation. The door drive mechanism 20 has a screw shaft 21 extending in the front-back direction, and a moving portion 22 that moves along the axial direction of the screw shaft 21 by drive of an electric motor (not shown). A casing 23 of the moving portion 22 is fixed to the door-side fixed portion 15. The end portions of the screw shaft 21 are supported by the guide frames 13, respectively.

In the plug door system 1, after the plug door 2 locked to the vehicle 100 is unlocked by the lock device 4 described hereinafter in detail, the door drive unit 3 executes a predetermined operation to open the plug door 2. Specifically, in order to open the plug door 2, the moving portion 22 is moved in an opening direction, along the axial direction of the screw shaft 21, by the rotation of the electric motor. Consequently, the door-side fixed portion 15 fixed to the casing 23 of the moving portion 22 and the plug door 2 also move in the opening direction. At the same time, the guide roller 16 of the door-side fixed portion 15 moves along the curved rail portion 12*b* and the straight rail portion 12*a*. As a result, the plug door 2 executes the separation operation for moving in a separating direction and the opening operation for moving in the opening direction. Note that the guide member 17 and the screw shaft 21 are allowed by the guide frames 13 to move in the vehicle width direction C.

On the other hand, in order to close the plug door 2, operations opposite of the foregoing operations are executed. Specifically, the electric motor rotates in a direction opposite to the direction described above. Consequently, the moving portion 22 moves in a closing direction, along the axial direction of the screw shaft 21. As a result, the plug door 2 also moves in the closing direction. At the same time, because the guide roller 16 moves along the straight rail portion 12*a* and the curved rail portion 12*b*, the plug door 2 executes the closing operation for moving in the closing direction and the attachment operation for moving in an attachment direction. Thereafter, the plug door 2 is further drawn in the attachment direction by a rotary lock mechanism 5, which is described hereinafter in detail, and is then locked to the vehicle 100 by the rotary lock mechanism 5. As a result, the plug door 2 is closed and locked to the vehicle 100.

[Lock Device]

The lock device 4 is a device that is installed in the vehicle 100 and mechanically locks the plug door 2 to the vehicle 100, with the plug door 2 attached to the vehicle 100. The vehicle is kept airtight by locking the plug door 2 to the vehicle 100 with the plug door 2 attached thereto. As shown in FIG. 1, the lock device 4 has a plurality of (two, in the present embodiment) rotary lock mechanisms 5, a latching lock mechanism 6, and a control unit 7. The lock device 4 is fixed to a plate-like mount base 27 that is fixed on the door-tail side of the doorway 101 in the vehicle 100 and elongated in the vertical direction. Thus, the lock device 4 is fixed to the vehicle 100.

[Configuration of the Rotary Lock Mechanisms]

The rotary lock mechanisms 5 draw, toward the inside of the vehicle, the locking bolts 26 that move integrally with the plug door 2 when the plug door 2 executes the closing operation and the attachment operation. In other words, the rotary lock mechanisms 5 close the plug door 2 completely by drawing the plug door 2 in the attachment direction. At this moment, the rotary lock mechanisms 5 enter a locking state to lock the completely closed plug door 2 with respect to the vehicle 100.

On the other hand, the rotary lock mechanisms 5 also enter a release state in which the rotary lock mechanisms 5 execute a release operation for unlocking the locking bolts 26 before the completely closed plug door 2 executes the separation operation and the opening operation. This enables the plug door 2 to execute the separation operation and the opening operation. Upon completion of the separation operation and the opening operation, the plug door 2 is opened completely.

These two rotary lock mechanisms 5 are provided in an upper section and a lower section of the vehicle 100, respectively, as shown in FIG. 1. More specifically, the upper rotary lock mechanism 5 is provided to correspond to the locking bolt 26 on the upper side of the plug door 2 in the vertical direction. The lower rotary lock mechanism 5, on the other hand, is provided to correspond to the locking bolt 26 on the lower side of the plug door 2 in the vertical direction. The upper rotary lock mechanism 5 and the lower rotary lock mechanism 5 share the same configuration. However, the upper rotary lock mechanism 5 and the lower rotary lock mechanism 5 may have mutually different configurations.

Figure 4:
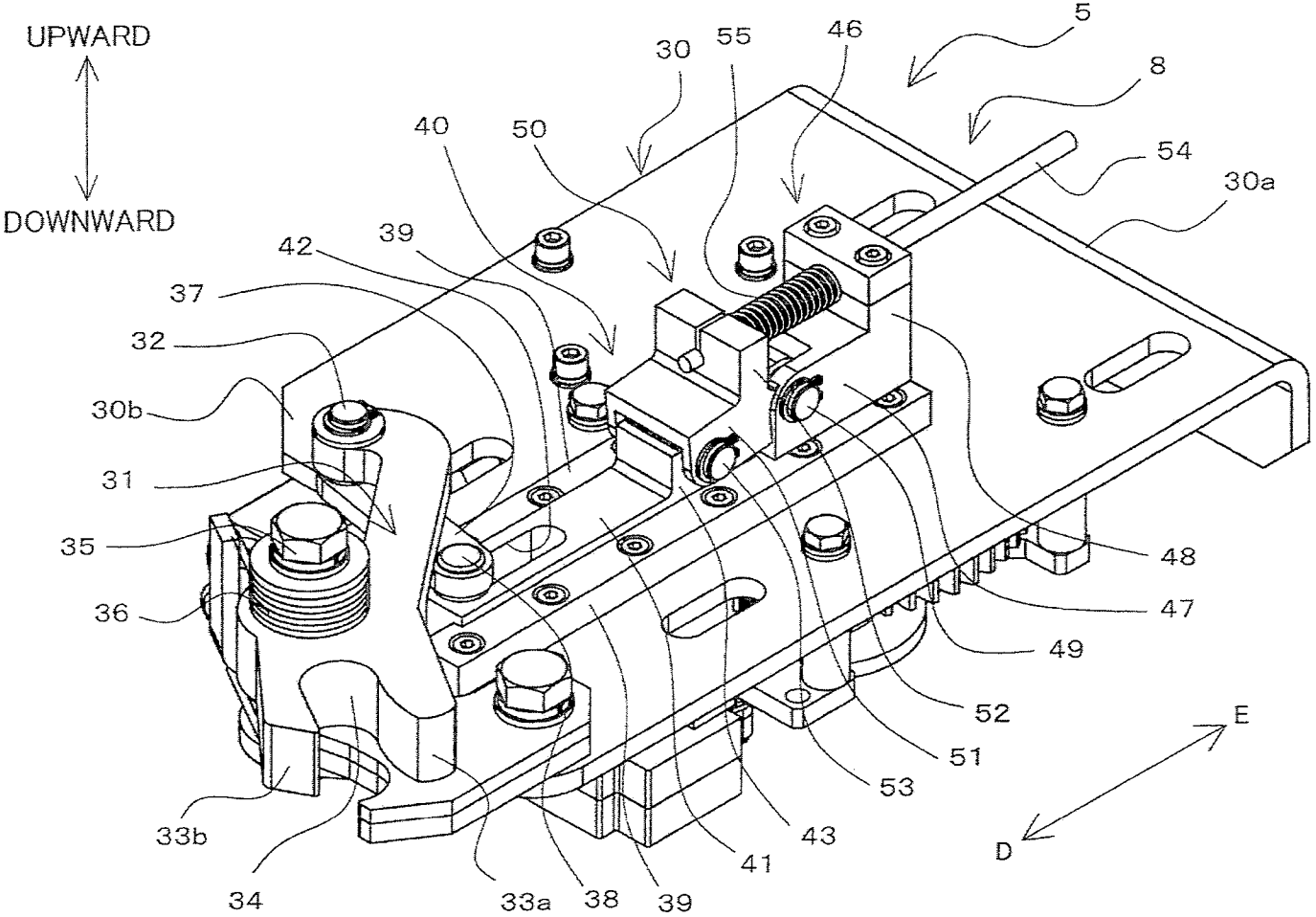
FIG. 4 is a perspective view showing a rotary lock mechanism from obliquely above.
Figure 5:
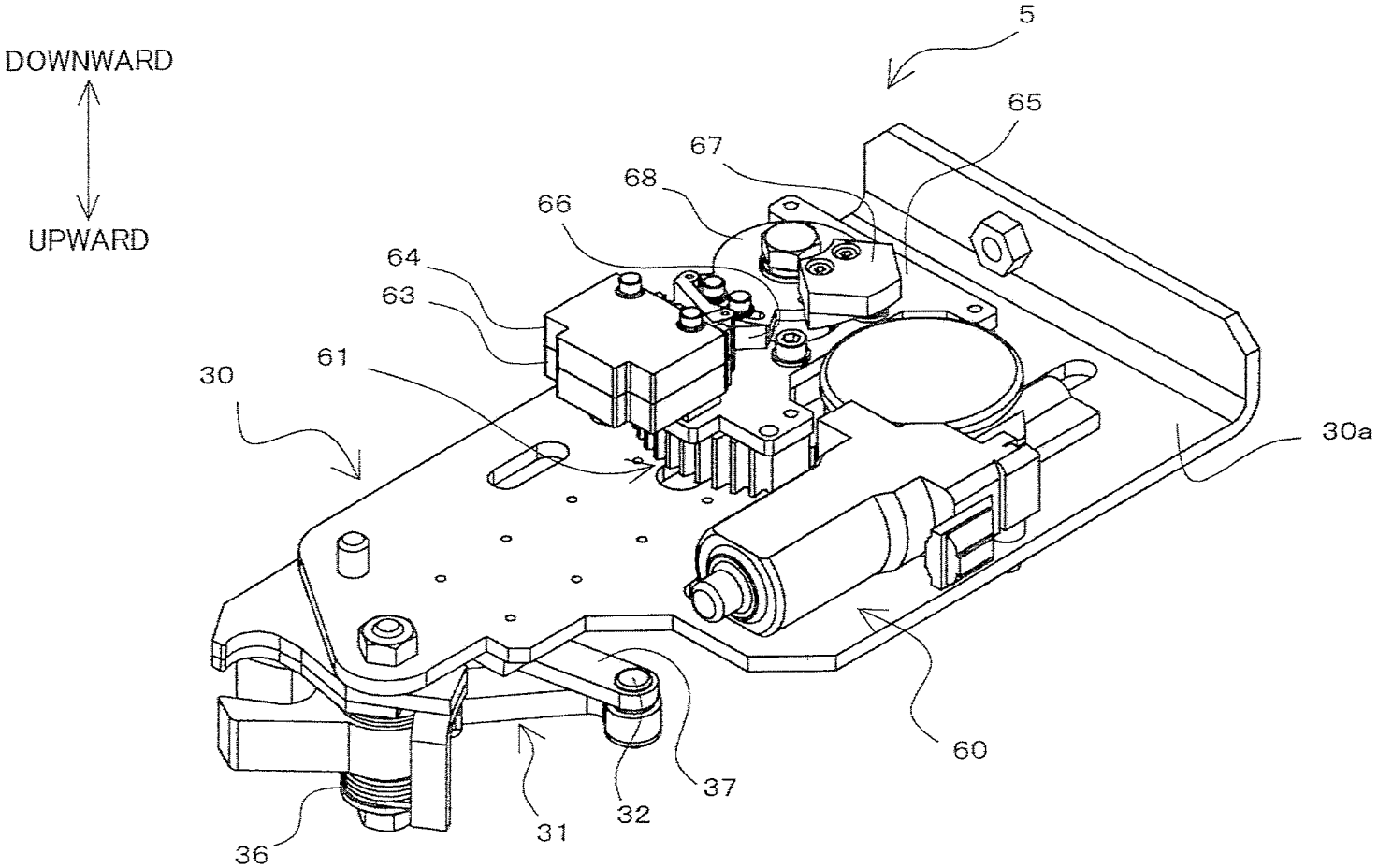
FIG. 5 is a perspective view showing the rotary lock mechanism from obliquely below.
Figure 6:
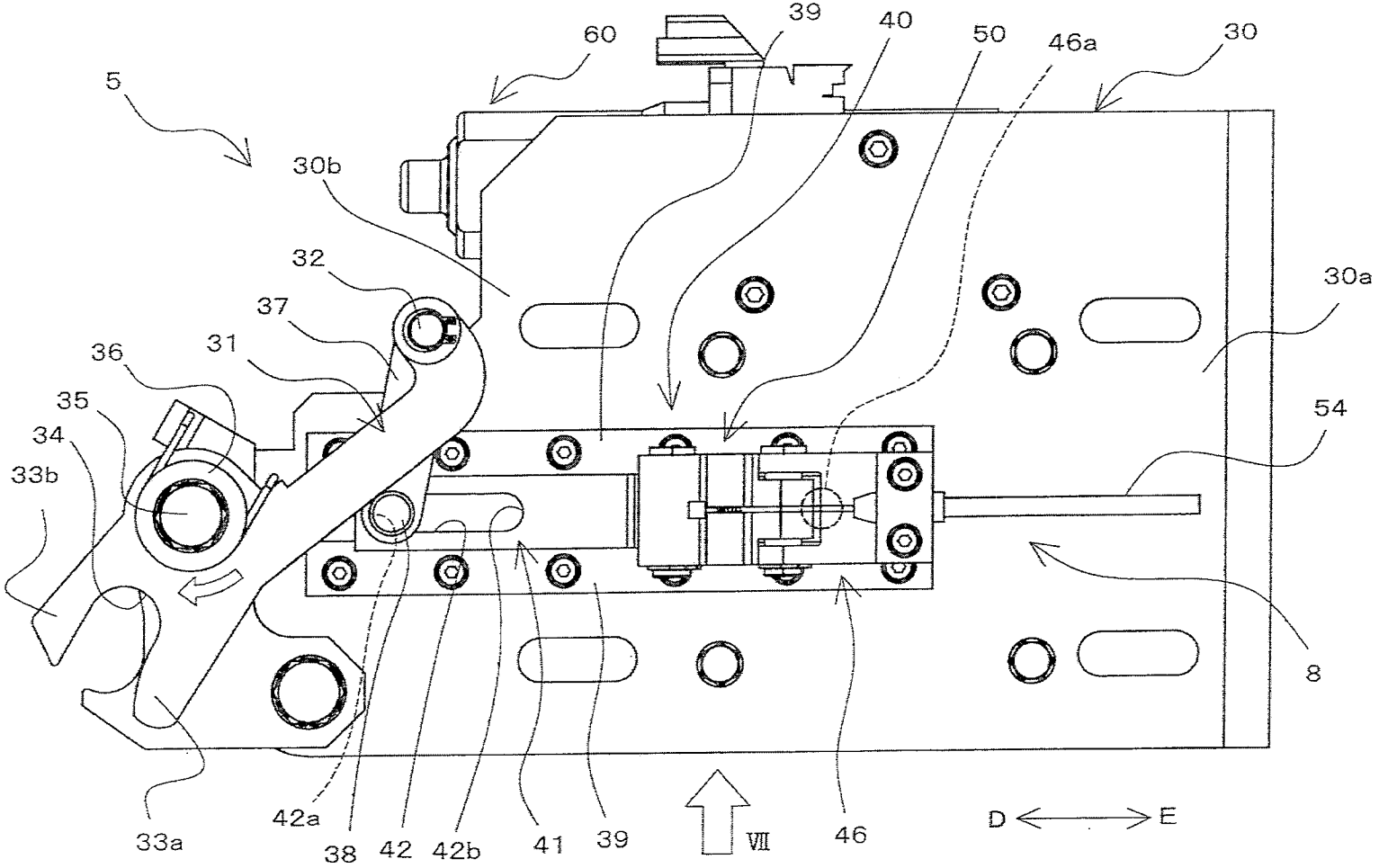
FIG. 6 is a plan view of the rotary lock mechanism.

FIGS. 4 to 7 are each a diagram for illustrating the configuration of the rotary lock mechanisms 5. FIG. 4 is a perspective view showing one of the rotary lock mechanisms 5 from obliquely above. FIG. 5 is a perspective view showing the rotary lock mechanism 5 from obliquely below. FIG. 6 is a plan view, and FIG. 7 a side view. The rotary lock mechanism 5 has a base plate 30, a lock arm 31, a link member 37, a sliding portion 40, and the like. Note that FIGS. 4 to 7 each show the rotary lock mechanism 5 in the locking state.

The base plate 30 is a plate-like member made of metal, and is provided in such a manner as to spread along a plane perpendicular to the vertical direction. The base plate 30 has its base end portion 30*a* fixed to the mount base 27 by a bolt or the like. As shown in FIG. 4, FIG. 6 and the like, the lock arm 31, the link member 37, rail portions 39, the sliding portion 40 and the like are disposed on an upper surface of the base plate 30. On the other hand, below the base plate 30 are an electric motor 60, a spur gear 61, a lock detection switch 63, a release detection switch 64, a lock detection switch cam 66, a release detection switch cam 67 and the like, as shown in FIG. 5 and the like. In other words, the plurality of rotary lock mechanisms 5 each have the electric motor 60 for locking the plug door 2.

The lock arm 31 is an elongated member provided at a portion on the side of tip (a tip end portion) 30*b* of the base plate 30. One end-side portion (base end portion) of the lock arm 31 is coupled rotatably to one end of the link member 37 by a coupling portion 32 (coupling section). The other end-side portion (tip end-side portion) of the lock arm 31 is provided with a pair of extending portions 33*a*, 33*b* extending side by side along a plane perpendicular to the vertical direction. An opening 34 that is opened in a direction in which the pair of extending portions 33*a*, 33*b* extends is formed between these extending portions 33*a*, 33*b*. In other words, the lock arm 31 is configured to branch from its main body into the extending portions 33*a*, 33*b* at its other end. The pair of extending portions 33*a*, 33*b* functions as an engagement portion with which the corresponding locking bolt 26 can come into engagement.

The middle section of the lock arm 31 (the section between the base end-side section and the pair of extending portions 33*a*, 33*b*) is coupled rotatably to the base plate 30 by a coupling portion 35. The lock arm 31, therefore, is capable of rotating about the coupling portion 35. In addition, a torsion spring 36 is attached to the rotary lock mechanism 5 in such a manner as to be positioned between the lock arm 31 and the base plate 30. The torsion spring 36 biases the lock arm 31 with respect to the base plate 30 in a clockwise direction as viewed from above (the direction of the white arrow shown in FIG. 6). In other words, the lock arm 31 is subjected to the elastic force of the torsion spring 36 in a direction of rotating from its locking state to its release state.

The link member 37 is a long, straight member extending in one direction. The link member 37 has its one end-side portion coupled rotatably to the lock arm 31 by the coupling portion 32. The other end-side portion of the link member 37 is provided with a cylindrical first projection 38. The first projection 38 is inserted into a first guide portion 42 formed in the sliding portion 40.

The rail portions 39 are a pair of straight members and fixed to the upper surface of the base plate 30. The rail portions 39 extend in parallel from the middle section of the lock arm 31 toward the base end of the base plate 30.

The sliding portion 40 has a slider 41, a movable portion 46, and a coupling link 50 (coupling portion). The sliding portion 40 also functions as a restricting portion for restricting a movement of a first section of the link member 37, described hereinafter, by coming into contact with the first section of the link member 37.

The sliding portion 40 is driven by the electric motor 60 to advance or retreat along the rail portions 39. Specifically, the sliding portion 40 is capable of advancing in an advancing direction (the direction of the arrow D shown in FIG. 4, FIG. 6 and the like) which is a direction from the base end portion 30*a* of the base plate 30 toward the tip end portion 30*b*, and retreating in a retreating direction (the direction of the arrow E) which is the direction opposite to the advancing direction. When the sliding portion 40 moves in the advancing direction, the sliding portion 40 moves toward the center of rotation of the lock arm 31. When, on the other hand, the sliding portion 40 moves in the retreating direction, the sliding portion 40 moves away from the center of rotation of the lock arm 31. Hereinafter, the advancing direction D is referred to as "front side" or "forward," and the retreating direction E as "rear side" or "rearward."

The slider 41 is an elongated, plate-like member that has a predetermined thickness in the vertical direction and is disposed between the pair of rail portions 39 so as to extend in the front-back direction. The slider 41 is capable of advancing or retreating while sliding with respect to the pair of rail portions 39. The rail portions 39 are configured in such a manner that the slider 41 (the sliding portion 40) moves on a straight line passing through the center of rotation of the lock arm 31.

The slit-like first guide portion 42 extending linearly in the advancing-retreating direction (front-back direction) of the slider 41 is formed in the front section of the slider 41. In other words, the sliding portion 40 moves linearly by being guided by the first guide portion 42. An end portion of the first guide portion 42 in the advancing direction D configures an advancing direction end portion 42*a* (see FIG. 6), and an end portion of the first guide portion 42 in the retreating direction E configures a retreating direction end portion 42*b*. The first projection 38 described above is inserted through the first guide portion 42. It should be noted that the first guide portion 42 may be formed into a through-hole to allow the slider 41 to pass therethrough in the vertical direction or into a concaved, bottomed groove on an upper surface of the slider 41.

The first guide portion 42 is configured so that the first projection 38 is able to move on a straight line along which passes through the center of rotation of the lock arm 31.

Figure 7:
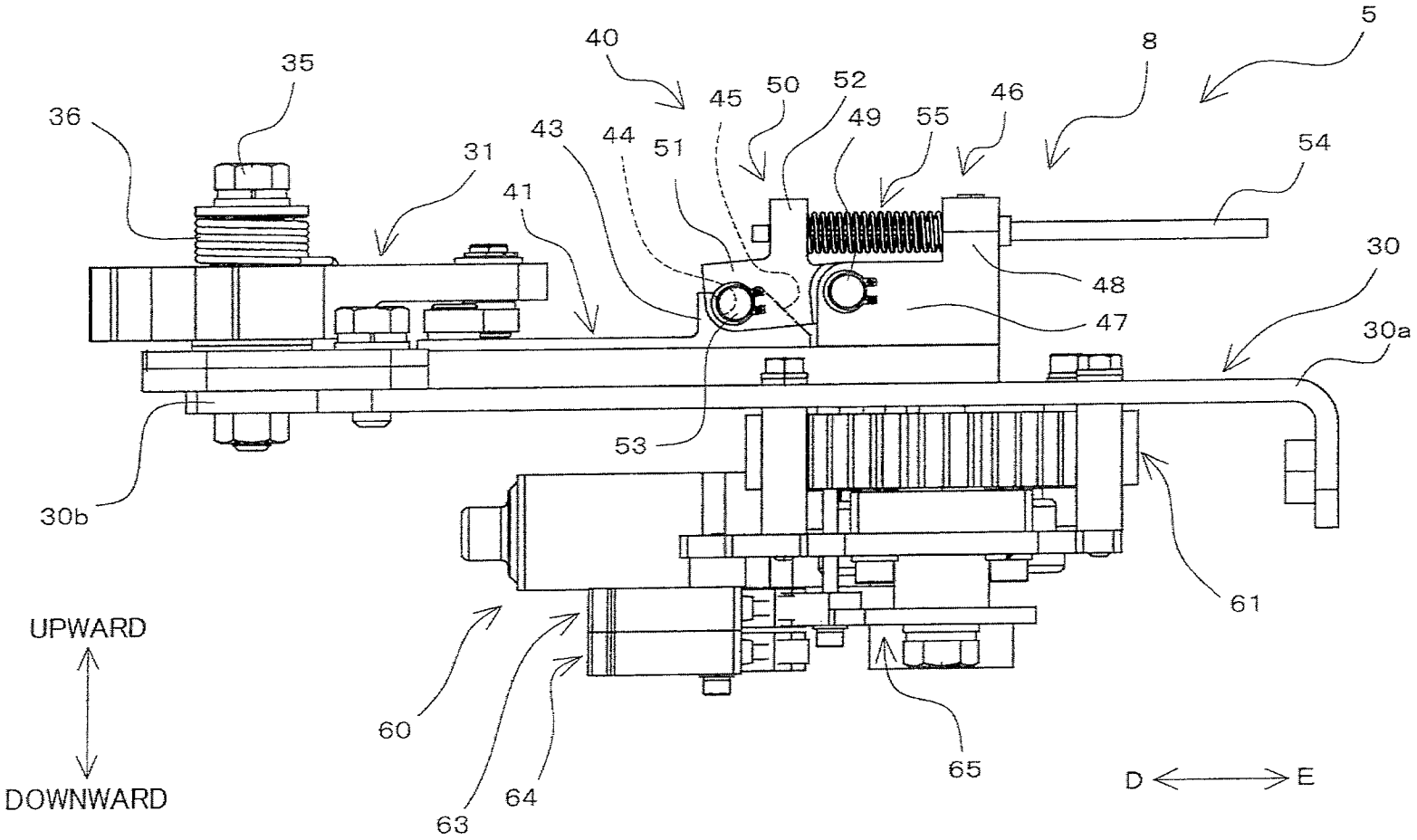
FIG. 7 is a side view of the rotary lock mechanism, viewed from a VII direction of FIG. 6.

A slider base 43 protruding upward is formed in the rear section of the slider 41. As shown in FIG. 7, a groove portion 44 extending in a direction perpendicular to the front-back direction is formed in the slider base 43, the direction being along a plane surface on which the base plate 30 extends. A flat, inclined surface 45 rising gradually forward as shown in FIG. 7 is formed in the rear section of the slider base 43.

The movable portion 46 is a substantially block-shaped section disposed behind the slider 41. The movable portion 46 has a rectangular parallelopiped-movable base 47 that is slightly flat in the vertical direction and a wall portion 48 that extends slightly upward from the rear section of the movable base 47. The front section of the movable base 47 is provided with the coupling link 50 capable of rotating via a first coupling pin 49. The first coupling pin 49 is provided in such a manner as to extend along the same direction as the direction in which the groove portion 44 extends.

A second projection 46*a* is formed on a lower end surface of the movable portion 46, as shown in FIG. 6. The second projection 46*a* is in a cylindrical shape and extends downward from the lower end surface of the movable portion 46. The second projection 46*a*, inserted into the through-hole of the base plate 30, is inserted into a second guide portion 62, which is described hereinafter. The through-hole is formed on the base plate 30 in such a manner as to penetrate the base plate 30 vertically at a section below the movable portion 46. Note that FIG. 6 omits the illustration of a lock spring 55 for convenience as it is described hereinafter in detail.

The coupling link 50 couples the slider 41 and the movable portion 46 to each other. In the present embodiment, the coupling link 50 is also capable of disconnecting the slider 41 and the movable portion 46 as described hereinafter; however, if a manual opening mechanism 8 is not provided, the configuration of the coupling link 50 is not limited thereto.

The coupling link 50 has a coupling portion main body that is integrated with a link basal portion 51 which is the block-shaped section and a wall portion 52 that extends slightly upward from the rear section of the link basal portion 51. In addition, a second coupling pin 53 (rod-like portion) is mounted on the front section of the link basal portion 51. The second coupling pin 53 extends in the same direction as the direction in which the first coupling pin 49 extends and the direction in which the groove portion 44 of the slider 41 extends. The coupling link 50 is joined to the movable portion 46 so as to be able to freely rotate about the first coupling pin 49.

The slider 41 and the movable portion 46 are coupled to each other by the coupling link 50, as shown in FIGS. 4 to 7. Specifically, the slider 41 and the movable portion 46 are coupled to each other by fitting the second coupling pin 53 of the coupling link 50 into the groove portion 44 of the slider 41, the coupling link 50 being coupled rotatably to the movable portion 46. The sliding portion 40 also configures part of the manual opening mechanism 8, which is described hereinafter in detail, and a certain operation executed on the manual opening mechanism 8 disconnects the slider 41 and the movable portion 46 from each other.

As described above, the electric motor 60, the spur gear 61, the lock detection switch 63, the release detection switch 64, the lock detection switch cam 66, the release detection switch cam 67 and the like are disposed on a lower surface of the base plate 30, as shown in FIG. 5.

Figure 8:
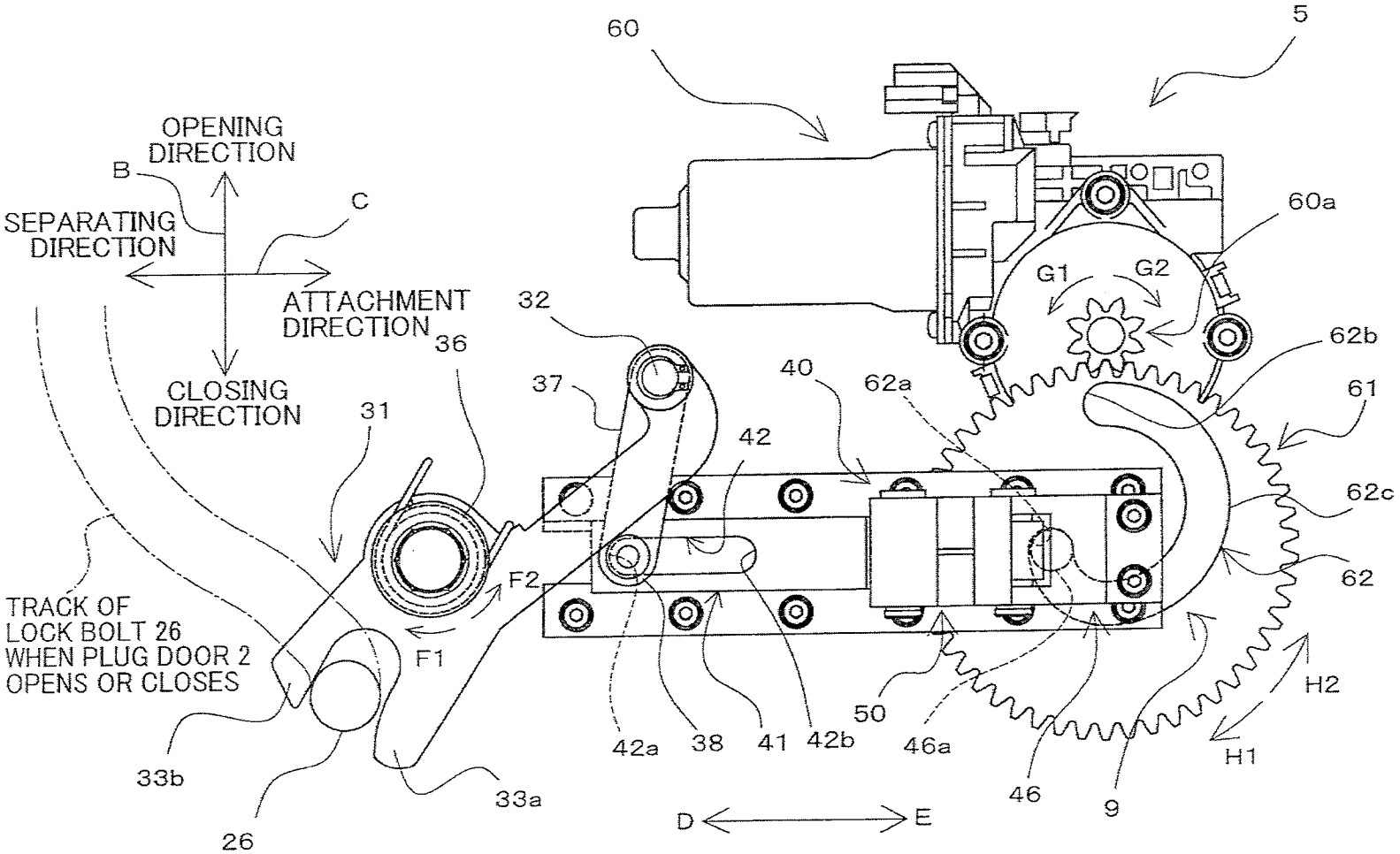
FIG. 8 is a plan view of the rotary lock mechanism in a locking state, wherein the illustrations of a base plate and the like are omitted.
Figure 9:
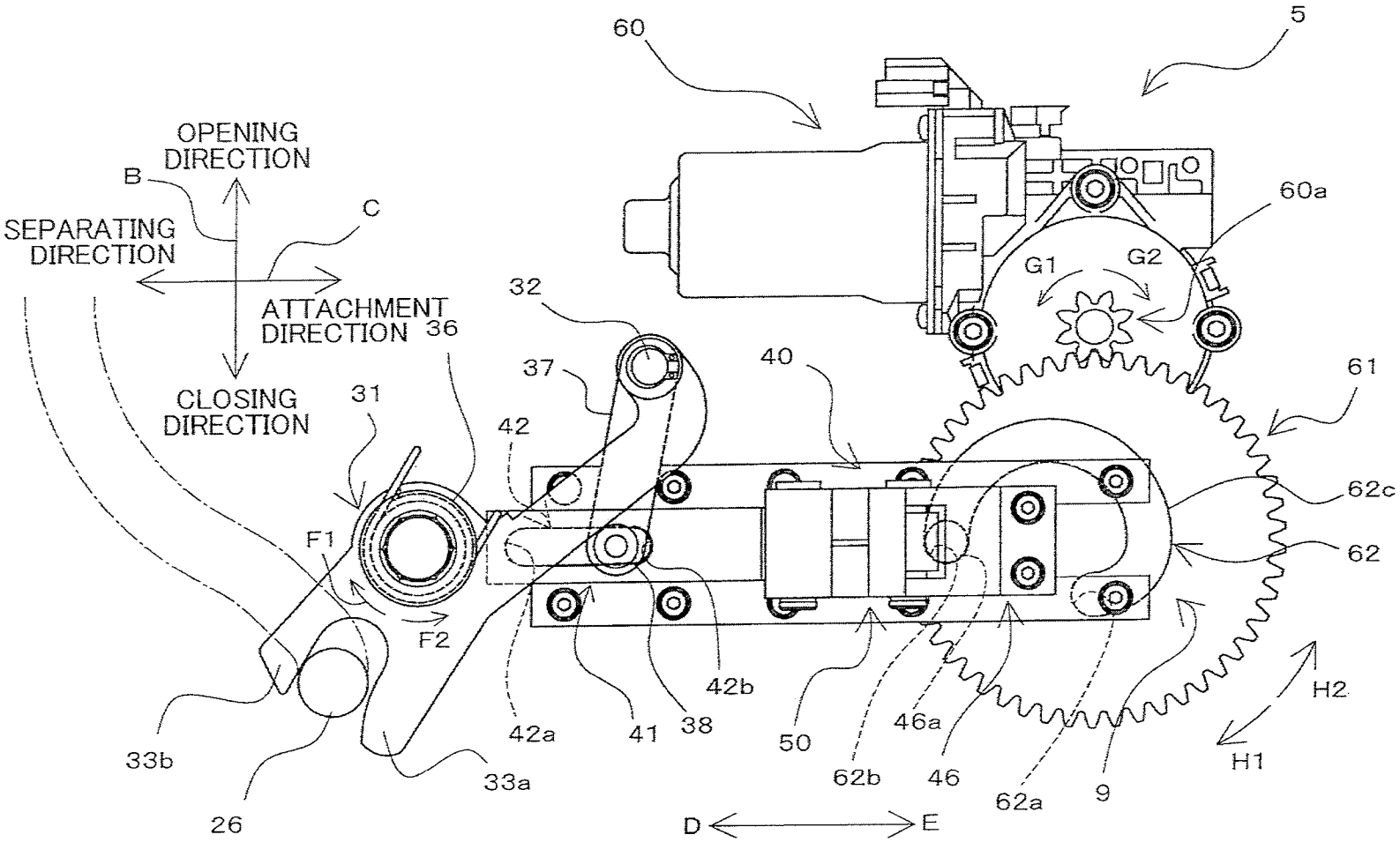
FIG. 9 is a plan view of the rotary lock mechanism showing a state in which a sliding portion advances in an advancing direction, the plan view corresponding to FIG. 8.
Figure 10:
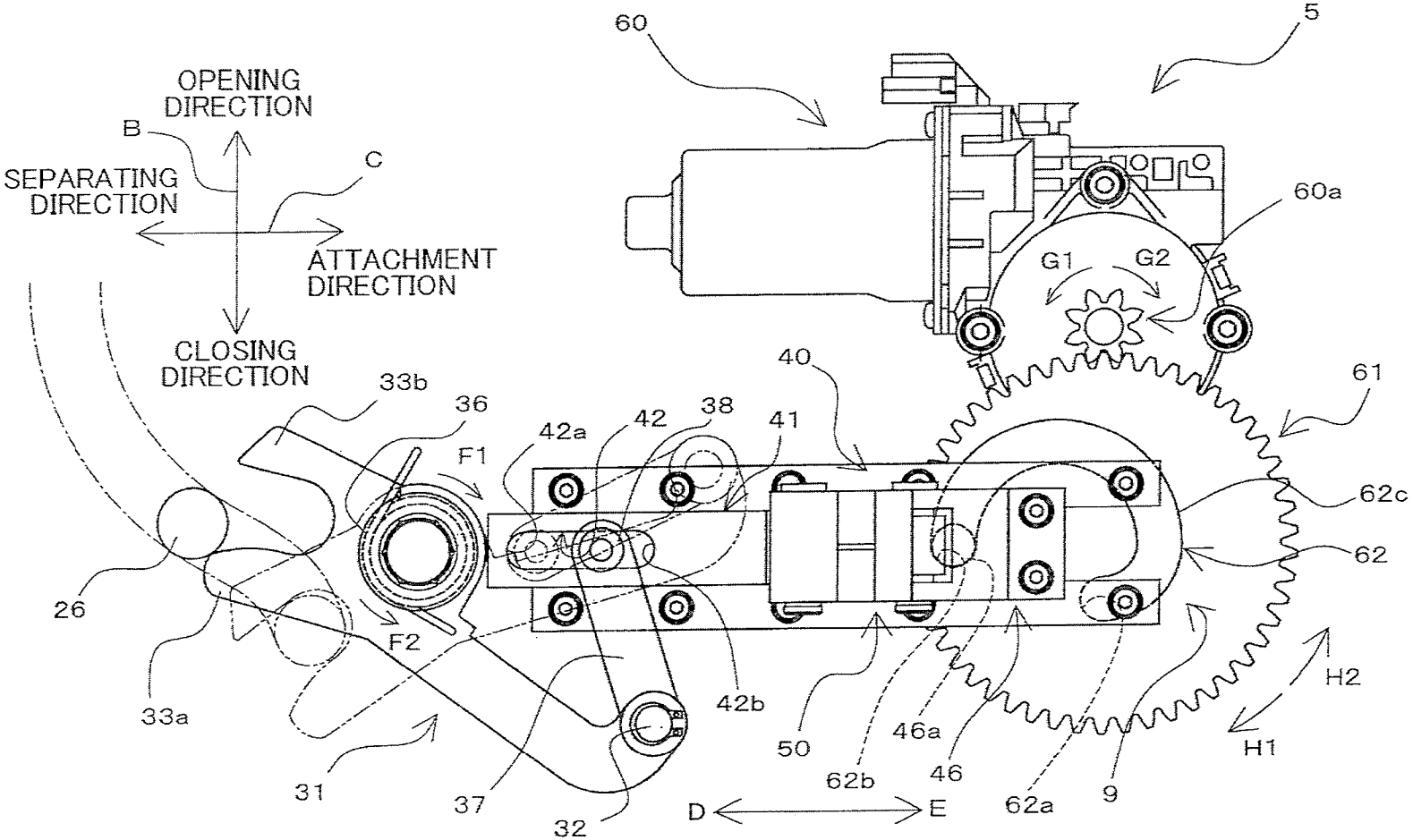
FIG. 10 is a plan view of the rotary lock mechanism in a release state, the plan view corresponding to FIG. 8.

The electric motor 60 causes the sliding portion 40 to advance or retreat by means of the spur gear 61 that is described hereinafter in detail. As described hereinafter in detail, the electric motor 60 has a pinion gear 60*a* as shown in FIGS. 8 to 10. Driving the electric motor 60 leads to rotation of the pinion gear 60*a*.

The spur gear 61 is provided as a rotary portion that is attached rotatably to the base plate 30. The spur gear 61 is in mesh with the pinion gear 60*a*. Therefore, when the pinion gear 60*a* rotates, the spur gear 61 rotates as well.

FIG. 8 is a plan view of one of the rotary lock mechanisms 5, wherein the illustrations of the base plate 30 and the like is omitted. As shown in FIG. 8, the second guide portion 62 is formed in the spur gear 61. The second guide portion 62 is formed into a groove on an upper surface of the spur gear 61 and provided as a spiral-shaped, elongated hole extending into a spiral, turning approximately 270 degrees.

More specifically, the second guide portion 62 has an inner end portion 62*a*, an outer end portion 62*b*, and a middle section 62*c*, as shown in FIG. 8. The inner end portion 62*a* is one of the end portions of the second guide portion 62 in a longitudinal direction, located in the vicinity of the axis of rotation of the spur gear 61. The outer end portion 62*b* is the other end portion of the second guide portion 62 in the longitudinal direction, located away from the axis of rotation of the spur gear 61. The middle section 62*c* is formed between the inner end portion 62*a* and the outer end portion 62*b* of the second guide portion 62, in such a manner as to separate from the axis of rotation of the spur gear 61 as extending from the inner end portion 62*a* toward the outer end portion 62*b*.

The second projection 46*a* described above is inserted through the second guide portion 62. The second projection 46*a* is capable of sliding along the middle section 62*c* from the inner end portion 62*a* of the second guide portion 62 to the outer end portion 62*b*. However, the spur gear 61 cannot be rotated when the second projection 46*a* moves in the advancing-retreating direction. In other words, even when the second projection 46*a* (the sliding portion 40) attempts to move linearly, the force of such motion cannot rotate the spur gear 61. Therefore, when the spur gear 61 does not rotate, the movable portion 46 (the sliding portion 40) cannot be caused to advance or retreat.

In relation to the electric motor 60 and the spur gear 61, the spur gear 61 rotates as the electric motor 60 rotates. At this moment, the second projection 46*a* formed in the movable portion 46 of the sliding portion 40 is caused to advance along the advancing direction D and retreat along the retreating direction E by the second guide portion 62 formed in the spur gear 61. Consequently, the sliding portion 40 advances/retreats.

As shown in FIG. 5, the lock detection switch 63 and the release detection switch 64 are fixed to a switch holder 65, which are then held on the base plate 30. The switch holder 65 is provided below the spur gear 61 and fixed with respect to the base plate 30. The lock detection switch 63 is fixed under the switch holder 65, whereas the release detection switch 64 is overlapped on a lower surface of the lock detection switch 63.

The lock detection switch cam 66 and the release detection switch cam 67 are provided so as to correspond to the lock detection switch 63 and the release detection switch 64, respectively.

The lock detection switch cam 66 is fixed to the spur gear 61 via a cam plate 68 on a lower surface of the spur gear 61. The lock detection switch cam 66 is provided on the same level as the lock detection switch 63 in the vertical direction, and a switch portion of the lock detection switch 63 is turned on when the rotary lock mechanism 5 enters its locking state.

The release detection switch cam 67 is fixed to the spur gear 61 by being fixed to a lower surface of the lock detection switch cam 66. The release detection switch cam 67 is provided on the same level as the release detection switch 64 in the vertical direction, and a switch portion of the release detection switch 64 is turned on when the rotary lock mechanism 5 enters its release state.

The latching lock mechanism 6 has a latch mechanism, not shown. In the latch mechanism, when the plug door 2 executes the closing operation and the plug operation, the locking bolts (not shown) formed on the plug door 2 press the latch mechanism, bringing the plug door 2 into the locking state and thereby fixing the plug door 2 to the vehicle 100. On the other hand, when the plug door 2 executes the opening operation, the electric motor (not shown) activates, releasing the locking state of the latch mechanism and thereby allowing the plug door 2 to execute the opening operation. Note that, unlike the rotary lock mechanism 5 described above, the latching lock mechanism 6 does not require electric power for bringing the plug door 2 into the locking state. For this reason, in the case of failure in the power source of the lock device 4, even when the plug door 2 executes the closing operation and the attachment operation, the plug door 2 can mechanically be locked.

The control unit 7 is provided as a controller for switching the state of the rotary lock mechanism 5 by transmitting a lock command and a release command to the rotary lock mechanism 5. When the control unit 7 transmits a lock command, the rotary lock mechanism 5 enters its locking state. When the control unit 7 transmits a release command, the rotary lock mechanism 5 enters its release state. Upon reception of a signal for opening the plug door 2 that is completely closed, the control unit 7 transmits the release command to the rotary lock mechanism 5. On the other hand, upon reception of a signal indicating that the plug door 2, completely opened, has executed the closing operation and the attachment operation, the control unit 7 transmits the lock command to the rotary lock mechanism 5. In other words, the control unit 7 drives the electric motor 60, when the door leaf is in a state that the door leaf is attached to the doorway of the vehicle as a result of executing the plug operation. The control unit 7 transmits the lock command and the release command to each rotary lock mechanism 5 at different times. As a result, both of the rotary lock mechanisms 5 execute the locking operation and the release operation at different times. Note that the lock command may be output from the control unit 7 once a door closing switch provided in the vehicle is turned on. The door closing switch is turned on when the plug door 2 reaches its completely closed position (the position approximately several mm in front of the position where the plug door 2 becomes attached to the vehicle and stops).

[Configuration of the Manual Opening Mechanism]

The manual opening mechanism 8 manually brings the plug door 2 into an openable state, the plug door 2 being locked by the rotary lock mechanisms 5. Specifically, the manual opening mechanism 8 has a release cable 54 shown in FIGS. 4, 6, 7 and the like in addition to the slider 41, the movable portion 46, and the coupling link 50 described above. The release cable 54 is inserted through the through-hole formed on the wall portion 48 of the movable portion 46 and has its one end fixed to the wall portion 52 of the coupling link 50.

In the manual opening mechanism 8, the lock spring 55 is provided between the wall portion 48 of the movable portion 46 and the wall portion 52 of the coupling link 50. The lock spring 55 presses the wall portion 52 of the coupling link 50 forward with respect to the wall portion 48 of the movable portion 46. Consequently, the second coupling pin 53 of the coupling link 50 is pushed downward and thereby comes into engagement with the groove portion 44 of the slider 41, as shown in FIGS. 4, 7 and the like. Therefore, the slider 41 and the movable portion 46 are coupled to each other by the coupling link 50. In the present embodiment, the lock spring 55 that biases the coupling link 50 in the direction in which the second coupling pin 53 is brought into engagement with the groove portion 44, is configured by a coil spring. The lock spring 55 may be configured not only by a coil spring but also by a plate spring, torsion spring or the like. With any type of spring, a simple configuration can be accomplished.

[Operations of the Rotary Lock Mechanism]

FIGS. 8 to 10 are plan views of one of the rotary lock mechanisms 5, showing the operations of the rotary lock mechanism 5, wherein the illustrations of the base plate 30 and the like are omitted. The release operation and locking operation of the rotary lock mechanism 5 are described hereinafter with reference to FIGS. 8 to 10.

In a case where the plug door 2 is completely closed, the rotary lock mechanism 5 is in the state shown in FIG. 8 (the locking state). At this moment, in the rotary lock mechanism 5, the pair of extending portions 33*a*, 33*b* of the lock arm 31 are in engagement with a locking bolt 26 by sandwiching the locking bolt 26 therebetween. In other words, the positions of the lock arm 31 and of the link member 37 in the locking state are located in such a manner that the link member 37 is rotated in which the first projection 38 of the link member 37 moves in the advancing direction D as the lock arm 31 turns as a result of the opening motion of the plug door 2. The second projection 46*a* formed in the movable portion 46 of the sliding portion 40 is caused to retreat on the farthest side of the retreating direction E of the advancing-retreating direction by the inner end portion 62*a* of the second guide portion 62 formed in the spur gear 61. As a result, in the state in which the entire sliding portion 40 is retreated in the retreating direction E, the first projection 38 of the link member 37 and the advancing direction end portion 42*a* of the first guide portion 42 are in contact with each other.

In the foregoing state, even when a passenger applies force to the plug door 2 in the opening direction by forcibly opening the plug door 2, in the state shown in FIG. 8, the first projection 38 comes into contact with the advancing direction end portion 42*a* of the first guide portion 42 and the advancing-retreating motion of the sliding portion 40 is restricted by the second projection 46*a* and the second guide portion 62. In other words, the inner end portion 62*a* of the second guide portion 62 and the first guide portion 42 of the sliding portion 40 are set such that the advancing direction end portion 42*a* of the first guide portion 42 comes into contact with the first projection 38 within the range, where the position of the lock arm 31 is changed according to rotation thereof, when the sliding portion 40 is positioned on the farthest side of the retreating direction E. More specifically, the second guide portion 62 and the first guide portion 42 are configured to move the sliding portion 40 to the position where the first projection 38 that has moved in the advancing direction is brought into contact with the one end portion of the first guide portion 42 near the lock arm. For this reason, in a case where the sliding portion 40 (restricting portion) restricts the movement of the link member 37 when the spur gear 61 does not rotate, the lock arm 31 does not rotate in the release direction F1. Consequently, the plug door 2 is prevented from being opened in the opening direction. In other words, the second projection 46*a* and the second guide portion 62 each function as a rotation preventing mechanism 9 for restricting the lock arm 31 from rotating in the release direction F1. In other words, the lock mechanism 5 has the rotation preventing mechanism 9 that restricts a movement of a section (the first section) of the link member 37 other than the connection portion between the link member 37 and the lock arm 31 and thereby keeps the connection portion in a position beyond the dead center which is described hereinbelow. Specifically, the rotation preventing mechanism 9 restricts the lock arm 31 from being rotated in a direction (the release direction F1) opposite to a predetermined direction (a direction F2 of rotation of the lock arm 31 occurring when the plug door 2 is moved in the attachment direction) by force acting on the lock arm 31 in this opposite direction when the connection portion between the lock arm 31 and the link member 37 passes the dead center described hereinbelow. That is to say, the movement of the first section of the link member 37 is restricted by the restricting portion that mechanically comes into contact with the first section. Note that the first section is the section other than the coupling portion 32 in the link member 37, the section changing its position as the link member 37 moves. In the present embodiment, the first section configures the other end portion of the link member 37 (the end portion on the opposite side of the coupling portion 32).

Even in the case of failure in the electric motor 60, which can cause the rotor of the electric motor 60 to rotate freely, the rotation preventing mechanism 9 can prevent the plug door 2 from opening in the opening direction, as with the foregoing case.

[Release Operation]

In the locking state described above, when the rotary lock mechanism 5 receives the release command from the control unit 7, the pinion gear 60*a* of the electric motor 60 rotates in the direction of the arrow G1 shown in FIG. 8. Consequently, the spur gear 61 rotates in the direction of the arrow H1. As a result, the second projection 46*a* is caused to slide in the advancing direction D by the second guide portion 62 rotating in the direction H1. This causes the entire sliding portion 40 to advance in the advancing direction D along the rail portions 39. The sliding portion 40 moves in the advancing direction D until the second projection 46*a* comes into contact with the outer end portion 62*b* of the second guide portion 62 (see FIG. 9). As a result of this advancement of the sliding portion 40 in the advancing direction D, the first projection 38 separates from the advancing direction end portion 42*a* of the first guide portion 42 and approaches the retreating direction end portion 42*b*, as shown in FIG. 9.

When the spur gear 61 rotates until the second projection 46*a* comes into contact with the outer end portion 62*b* of the second guide portion 62 as shown in FIG. 9, the release detection switch cam 67 attached to the spur gear 61 turns the switch portion of the release detection switch 64 on. Consequently, the door drive unit 3 is driven, moving the plug door 2 in the separating direction and the opening direction. At this moment, the locking bolt 26 fixed to the plug door 2 is also moved in the same direction. As a result, the locking bolt 26 presses the extending portion 33*b* of the lock arm 31 in the opening direction. At this moment, because the advancing direction end portion 42*a* of the first guide portion 42 is separated from the first projection 38, the lock arm 31 is in a rotatable state. Accordingly, while the first projection 38 of the link member 37 moves in the advancing direction D along the first guide portion 42, the lock arm 31 rotates in the release direction F1. As a result, the engagement between the lock arm 31 and the locking bolt 26 is released, bringing the rotary lock mechanism 5 into its release state, as shown in FIG. 10. In other words, the inner end portion 62*a* of the second guide portion 62 and the first guide portion 42 of the sliding portion 40 are set in such a manner that the advancing direction end portion (one end on the lock arm side) 42*a* of the first guide portion 42 does not come into contact with the first projection 38 within the range of rotation of the lock arm 31 when the sliding portion 40 is located on the farthest side of the advancing direction D. For this reason, the rotary movement of the lock arm 31 is not restricted by the sliding portion 40.

[Locking Operation]

When the plug door 2 is closed in the foregoing release state, the locking bolt 26 also moves in the same direction as the plug door 2 to come into contact with the extending portion 33*a* of the lock arm 31 (see FIG. 10), pressing the extending portion 33*a* in the locking direction F2. The locking bolt 26 then keeps moving in the same direction, rotating the lock arm 31 in the locking direction F2. At this moment, the lock arm 31 and the link member 37 are operated as follows. Specifically, while the first projection 38 of the link member 37 moves in the advancing direction D, the lock arm 31 is rotated in the locking direction F2. Then, when the coupling link 50 (the sliding portion 40) passes the dead centre, the lock arm 31 rotates in the locking direction F2 while the first projection 38 of the link member 37 moves in the retreating direction E. The dead centre of the coupling link 50 (the sliding portion 40) is where the straight line in a slide direction that connects the center of rotation of the lock arm 31 and the center of the coupling link 50 becomes flush with the straight line that connects the center of the connection portion between the lock arm 31 and the link member 37 and the center of the first projection 38 and extends in the longitudinal direction of the link member 37. In other words, when the coupling link 50 (the sliding portion 40) is at the dead centre, the straight line connecting the center of rotation of the lock arm 31 and the connection portion and the straight line connecting the connection portion and the first projection 38 form a straight line together. Furthermore, the dead centre is located where the straight line connecting the center of rotation of the lock arm 31 and the connection portion becomes flush with the straight line extending in the slide direction of the sliding portion 40. When the coupling link 50 (the sliding portion 40) is in the dead center, the connection portion is present on the straight line connecting the center of the coupling link 50 (the sliding portion 40) and the center of the first projection 38. As shown by a two-dot chain line in FIG. 10, the lock arm 31 is rotated in the locking direction F2 until the plug door 2 is brought to a state prior to the completely closed state and the locking bolt 26 is brought to the position shown by a two-dot chain line.

Once the locking bolt 26 reaches the position shown by the two-dot chain line in FIG. 10, the rotary lock mechanism 5 begins the locking operation in response to the locking command. Specifically, once the rotary lock mechanism 5 receives the lock command, the pinion gear 60*a* of the electric motor 60 rotates in the direction of the arrow G2 shown in FIG. 10. Following this rotation, the spur gear 61 rotates in the direction of the arrow H2. Consequently, the second projection 46*a* is caused to slide in the retreating direction E by the second guide portion 62 rotating in the direction H2, moving the entire sliding portion 40 in the retreating direction E along the rail portions 39. As a result, the advancing direction end portion 42*a* of the first guide portion 42 comes into contact with the first projection 38. At this moment, the second projection 46*a* is positioned at the middle section 62*c* of the second guide portion 62.

When the spur gear 61 rotates further in the H2 direction in the foregoing state, the advancing direction end portion 42*a* of the first guide portion 42 of the sliding portion 40 pulls the first projection 38 in the retreating direction E. Because the spur gear 61 rotates until the second projection 46*a* comes into contact with the inner end portion 62*a* of the second guide portion 62, the first projection 38 is pulled in the retreating direction E as the spur gear 61 rotates. Consequently, the lock arm 31 is rotated in the locking direction F2 via the link member 37, and the lock arm 31 thereby draws the locking bolt 26 in the closing direction and the attachment direction. As a result, the plug door 2 is closed completely, ending the locking operation. The rotary lock mechanism 5 then enters the locking state shown in FIG. 8, wherein the plug door 2 is mechanically inhibited from moving in the opening direction and the separation direction. In other words, in the locking operation the torque of the electric motor 60 is converted to a linear operation of the sliding portion 40, and the linear operation of the sliding portion 40 is then converted into a rotary operation of the lock arm 31. During the locking operation, the first projection 38 moves in the advancing direction D along the first guide portion 42 as the lock arm 31 rotates by the pressing force of the locking bolt 26, until the first projection 38 reaches the dead centre. Then, by rotating the spur gear 61 in synchronization with the first projection 38 reaching the dead centre and inverting its direction of movement, the first projection 38 can easily be moved in the retreating direction E by the slider 41. In addition, due to the inertia force of the lock arm 31 acting in the vicinity of the dead centre, the direction of movement of the first projection 38 can be changed smoothly from the advancing direction D to the retreating direction E.

The lock device 4 according to the present embodiment, the release operation and lock operation described above are executed by each of the rotary lock mechanisms 5 at different timings. Thus, the peak power can be reduced more compared to when, for example, a plurality of electric motors 60 are drive at the same time. As a result, the power required and consumed at one time by the system for driving the lock device 4 can be reduced.

[Operation of Manual Opening Mechanism]

Figure 11:
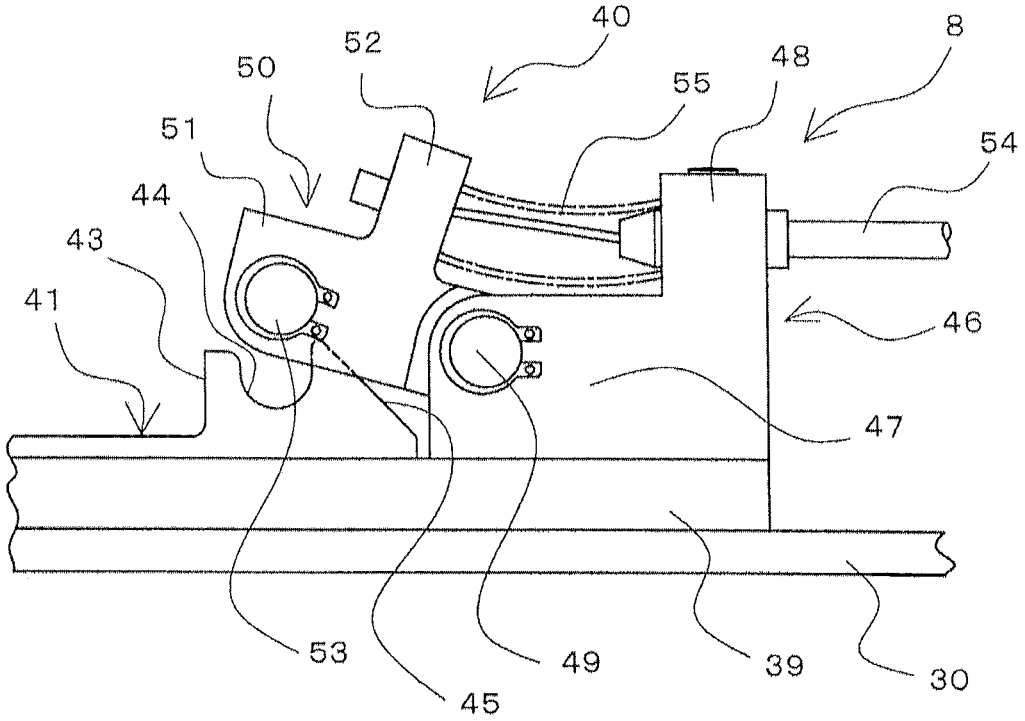
FIG. 11 is a diagram for explaining an operation of a manual opening mechanism, showing a state in which a movable portion and a slider are disconnected from each other.

FIG. 11 is a diagram for explaining an operation of the manual opening mechanism 8, showing a state in which the movable portion 46 and the slider 41 are disconnected. The manual opening mechanism 8 is used when manually unlocking the plug door 2 by means of the rotary lock mechanisms 5. Specifically, when a manual release switch, not shown, is turned on, the release cable 54 is pulled against the biasing force of the lock spring 55. Consequently, the second coupling pin 53 of the coupling link 50 is lifted upward with respect to the groove portion 44 of the slider 41 (see FIG. 11). As a result, the connection portion between the slider 41 and the movable portion 46 in the sliding portion 40 is released, bringing the rotary lock mechanism 5 into a manually opening state. The slider 41 then becomes capable of sliding in the advancing-retreating direction, although the spur gear 61 does not rotate. This makes the lock arm 31 rotatable, and thereby the plug door 2 can be opened manually.

In order to cancel the manually opening state described above (i.e., in order to couple the slider 41 and the movable portion 46 to each other again), the spur gear 61 may be rotated in the direction H1. Consequently, the movable portion 46 advances toward the slider 41. At this moment, the second coupling pin 53 of the coupling link 50 is moved along the inclined surface 45 formed on the slider base 43, and is then fitted in the groove portion 44. In this manner, the manually opening state can be canceled.

[Effects]

As described above, the lock device 4 according to the present invention has a plurality of rotary lock mechanisms 5. The each of rotary lock mechanisms 5 has the electric motor 60. According to this configuration, even when the electric motor 60 of one of the plurality of rotary lock mechanisms 5 does not run normally, the operation of the plug door 2 in the separation direction can be restricted as long as the rest of the rotary lock mechanisms 5 can be operated normally. In other words, unlike the prior art, the lock device 4 according to the present embodiment is configured to be able to prevent failure of a single motor from having an impact on the entire lock mechanisms.

Therefore, the lock device 4 with such a simple configuration can enhance the safety of the plug door 2.

Each of the rotary lock mechanisms 5 is configured by a relatively small number of simple components, such as the electric motor 60, the lock arm 31, the link member 37, the sliding portion 40, and the rotation preventing mechanism 9. Moreover, these components can be installed in a relatively narrow space in the vertical direction of the plug door 2. Such a configuration, therefore, can provide the lock device 4 of a small, simple structure.

Because the rotation preventing mechanism 9 of the rotary lock mechanism 5 can restrict the lock arm 31 from rotating in the release direction F1, the plug door 2 can mechanically be locked even when failure occurs in the electric motor 60. Such rotation of the lock arm 31 can be restricted by use of force smaller than force that directly holds the lock arm 31. In other words, the engagement between the lock arm 31 and the locking bolt 26 can be held with small force. Furthermore, since the first section configures the other end of the link member 37, the engagement between the lock arm 31 and the locking bolt 26 can be held with a smaller amount of force.

In addition, due to the restricting portion that restricts the first section trying to move toward the center of rotation of the lock arm 31, the rotation of the lock arm 31 can easily be restricted. In other words, the rotation of the lock arm can be restricted by the sliding portion 40 that guides the first section trying to move toward the center of rotation of the lock arm 31.

Moreover, in the rotary lock mechanism 5 the rotation of the lock arm 31 in the release direction F1 is restricted, by restricting the sliding portion 40 from advancing in the advancing direction D. As a result, the rotation of the lock arm 31 in the release direction F1 can easily be restricted.

In the rotary lock mechanism 5, the rotation preventing mechanism 9 can be configured by the relatively simple configurations of the second projection 46*a* and the second guide portion 62.

Also, because the second guide portion 62 is configured to inhibit movement of the restricting portion (the sliding portion 40), the rotation of the lock arm 31 in the release direction can be restricted even when excessive force is applied to the lock arm 31 and the like.

In the rotary lock mechanism 5, the ratio between the number of teeth of the pinion gear 60*a* fixed to the axis of rotation of the electric motor 60 and the number of teeth of the spur gear 61 is set at a desired value, so a desired reduction gear ratio can be obtained.

In the lock device 4 the slider 41 and the movable portion 46 can be disconnected from each other. Therefore, in case of emergency, for example, the locking state of the rotary lock mechanism 5 can be released manually, to open the plug door 2.

Also, in the lock device 4, when the electric motor 60 is rotated to move the movable portion 46 toward the slider 41 while the slider 41 and the movable portion 46 are disconnected from each other, the second coupling pin 53 of the coupling link 50 can be fitted in the groove portion 44 of the slider 41. As a result, the slider 41 and the movable portion 46 can coupled to each other easily. Moreover, the slider 41 and the movable portion 46 can be disconnected from each other easily by releasing the second coupling pin 53 from the groove portion 44.

In the lock device 4, the slider 41 and the movable portion 46, which were disconnected from each other, can be coupled to each other easily by moving the movable portion 46 in the advancing direction D by means of the electric motor 60.

In the lock device 4, the electric motors 60 of the respective rotary lock mechanisms 5 are driven at different timings. Thus, the power required and consumed at one time by the system for driving the lock device 4 can be reduced.

Furthermore, each of the electric motors 60 is driven after the plug door 2 is moved in the attachment direction and attached to the doorway, thereby bringing the rotary lock mechanism 5 into its locking state. This eliminates the need for the power for operating the plug door 2 in the attachment direction. Thus, the rating of the electric motor 60 can be lowered.

In the lock device 4, the torque of the electric motor 60, the drive source for bringing the rotary lock mechanism 5 into its locking state, can be used as the drive source of the plug door 2 for executing the plug operation.

The embodiment of the present invention was described above. However, the present invention is not limited to this embodiment, and various changes can be made thereto within the scope of claims. For instance, the following modifications may be implemented.

Figure 12:
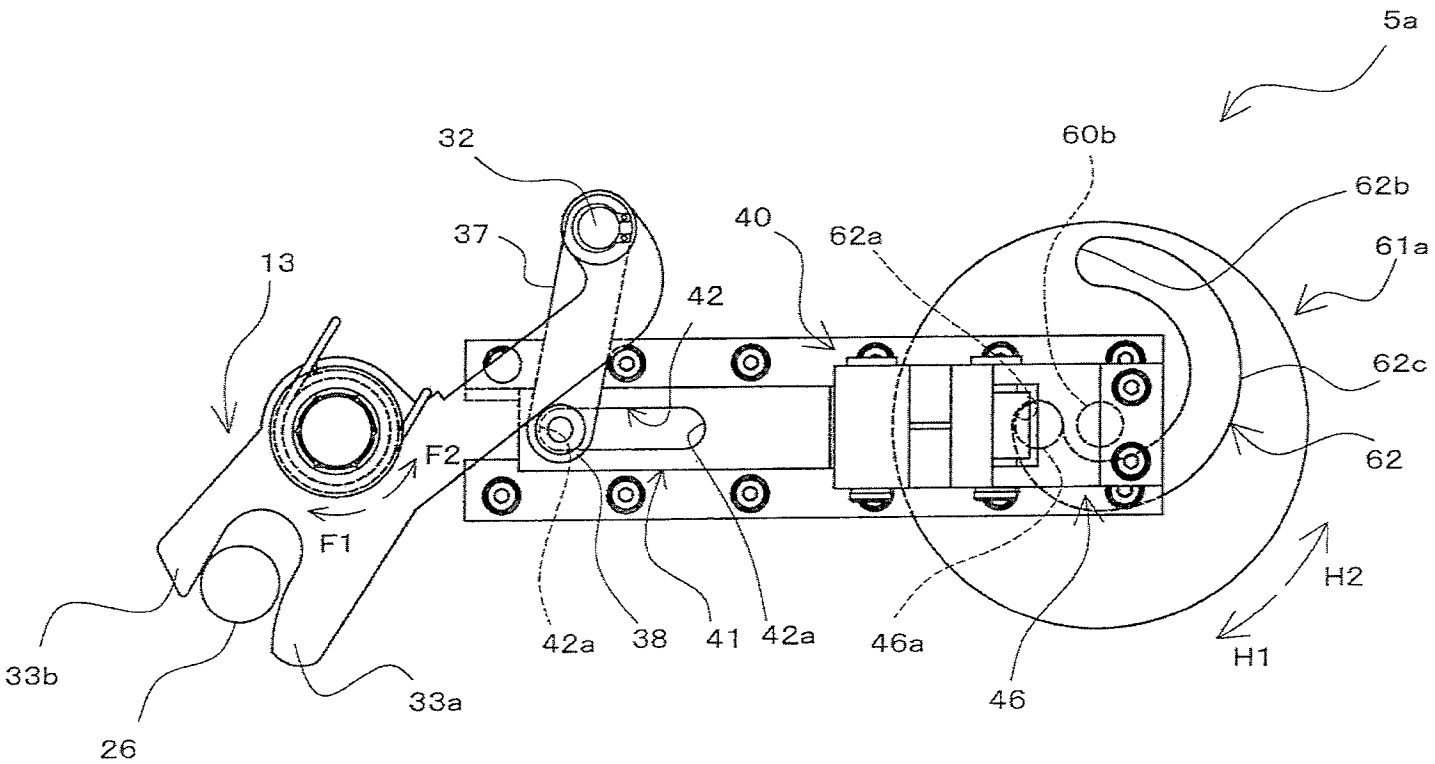
FIG. 12 is a plan view of the rotary lock mechanism according to a modification, the plan view corresponding to FIG. 8.

(1) FIG. 12 is a diagram for explaining the configuration of a rotary lock mechanism 5*a* according to a modification. In the foregoing embodiment, the spur gear 61, which is configured as a rotary portion provided with the second guide portion 62, is rotated by the pinion gear 60*a* of the electric motor 60; however, the embodiment is not limited to this configuration. Specifically, as shown in FIG. 12, an axis of rotation 60*b* of the electric motor (not shown) may be coupled to the center of a disk-shaped rotary portion 61*a* provided with the second guide portion 62. In this configuration, the rotary portion 61*a* can be rotated directly (i.e., without using a plurality of gears) by the axis of rotation 60*b* of the electric motor. Consequently, the configuration of the rotary lock mechanism 5*a* can be simplified.

In the lock device according to this modification, as in the foregoing embodiment, the rotary lock mechanism 5*a* is provided in two sections, the upper and lower sides of the plug door 2. Thus, as in the foregoing embodiment, the simplified structure can enhance the safety of the plug door 2.

Figure 13:
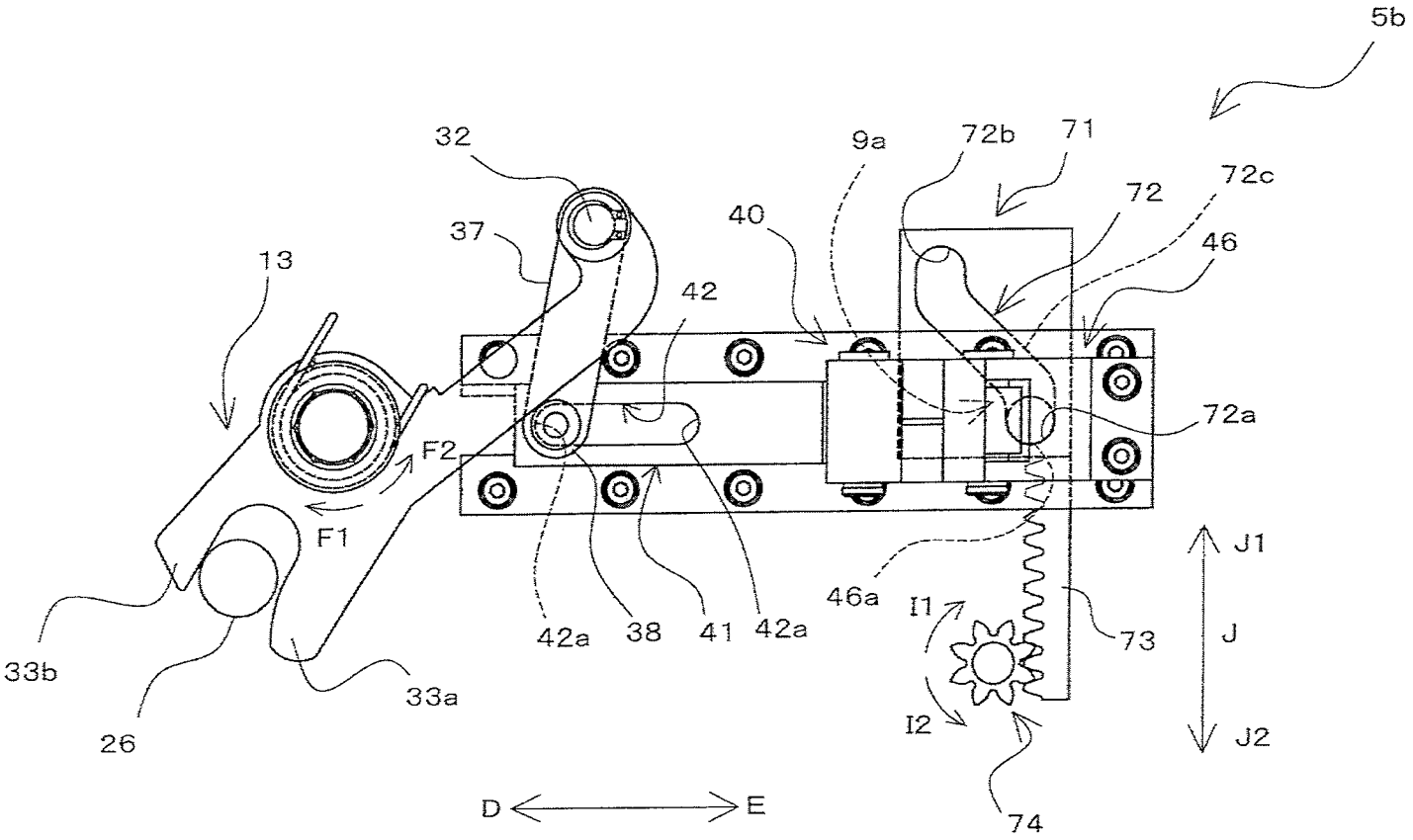
FIG. 13 is a plan view of the rotary lock mechanism according to a modification, the plan view corresponding to FIG. 8.

(2) FIG. 13 is a diagram schematically showing the configuration of a rotation preventing mechanism 9*a* of the rotary lock mechanism according to the modification. In the foregoing embodiment, the rotation preventing mechanism 9 is configured by the second guide portion 62 formed on the spur gear 61 functioning as the rotary portion, and the second projection 46*a* formed in the movable portion 46; however, the embodiment is not limited to this configuration. More specifically, as shown in FIG. 13, for example, a second guide portion 72 may be formed on a slide plate 71 capable of sliding in one direction.

As shown in FIG. 13, the slide plate 71 according to this modification is provided in such a manner as to be able to slide in a direction (direction J in FIG. 13) perpendicular to the advancing-retreating direction of the sliding portion 40. The slide plate 71 is provided integrally with a linear rack portion 73 extending along the slide direction J of the slide plate 71. The teeth portion of the rack portion 73 is in mesh with a pinion gear 74 fixed to the axis of rotation of the electric motor (both not shown). Thus, driving the electric motor to rotate the pinion gear 74 causes the slide plate 71 to slide in the slide direction J.

Also, the second guide portion 72 that is different in shape from the one described in the foregoing embodiment is formed on the slide plate 71. The second guide portion 72 is shaped into an elongated hole penetrating the slide plate 71 in the thickness direction. As in the foregoing embodiment, the second projection 46*a* of the movable portion 46 is inserted through the second guide portion 72.

The second guide portion 72 according to this modification has a first end portion 72*a*, a second end portion 72*b*, and a middle section 72*c*. The first end portion 72*a* is provided on a corner that is located in the vicinity of the rack portion 73 of the slide plate 71, toward the retreating direction E side. The second end portion 72*b* is provided on a corner that is located away from the rack portion 73 of the slide plate 71, toward the advancing direction D side. The middle section 72*c* is formed linearly between the first and second end portions 72*a* and 72*b* of the second guide portion 72, to connect the first end portion 72*a* and the second end portion 72*b* to each other.

In a rotary lock mechanism 5*b* according to this modification, when the sliding portion 40 is caused to advance in the advancing direction D, the pinion gear 74 rotates in the direction of the arrow I1 shown in FIG. 13. Consequently, the slide plate 71 slides rearward (the direction J2 shown in FIG. 13). Then, the second projection 46*a* moves from the first end portion 72*a* toward the second end portion 72*b* and moves relative to the slide plate 71. As a result, since the second projection 46*a* moves in the advancing direction D, the sliding portion 40 can be moved in the advancing direction D. When, on the other hand, the sliding portion 40 is caused to retreat in the retreating direction E, the pinion gear 74 may be rotated in the direction of the arrow I2 shown in FIG. 13.

In the lock device according to this modification, as in the foregoing embodiment, the rotary lock mechanism 5*b* is provided in two sections, the upper and lower sides of the plug door 2. Thus, as in the foregoing embodiment, the simplified structure can enhance the safety of the plug door 2.

Moreover, in a case where the rotary lock mechanism 5*b* according to this modification is in its locking state as shown in FIG. 13, even when trying to open the plug door 2, the sliding portion 40 cannot be moved in the advancing-retreating direction because the second projection 46*a* is held by the first end portion 72*a*. Therefore, the lock arm 31 cannot be rotated in the release direction F1, preventing the plug door 2 from opening in the opening direction, as in the foregoing embodiment.

(3) In the foregoing embodiment, each rotary lock mechanism 5 is operated with respect to the plug door 2 prior to the completion of the attachment operation, whereby the plug door 2 is drawn in the attachment direction to complete the attachment operation and to lock the plug door 2. However, the embodiment is not limited to this and each rotary lock mechanism 5 may be operated after the attachment operation of the plug door 2 is completed (i.e., after the plug door 2 is completely closed). This eliminates the need for the power for the electric motor 60 to operate the plug door 2 in the attachment direction, lowering the rating of the electric motor 60.

The foregoing embodiment is summarized below.

(1) The plug door lock device of the present embodiment is installed in a vehicle. The plug door lock device locks, with respect to the vehicle, a door leaf (2) that executes an opening/closing operation for opening/closing a doorway by moving in a front-back direction of the vehicle and a plug operation for coming into contact with or separating from the vehicle by moving in a width direction of the vehicle. The plug door lock device is provided with a plurality of lock mechanisms (5), each of which has a motor for locking the door leaf (2).

According to this configuration, the plug door lock device has a plurality of lock mechanisms. Each of the plurality of lock mechanisms has a motor. In this configuration, the motor of each lock mechanism is driven when the door leaf moves toward the inside of the vehicle (the attachment direction in which the door leaf is attached to the vehicle) in the vehicle width direction. When the door leaf is locked, movement of the door leaf toward the outside of the vehicle (the separation direction in which the door leaf separates from the doorway) is restricted.

According to this configuration, even when the motor of one of the plurality of lock mechanisms does not run normally, the operation of the door leaf in the separation direction can be restricted as long as the rest of the lock mechanisms can be operated normally. In other words, unlike the prior art, the lock device according to the present embodiment is configured to be able to prevent failure of a single motor from having an impact on the entire lock mechanisms. In addition, unlike the prior art, this configuration does not require a universal joint for operating the plurality of lock mechanisms with a single motor, thereby simplifying the structure.

According to this configuration, therefore, the safety of the plug door (door leaf) can be improved by the simplified structure.

(2) It is preferred that each of the lock mechanisms (5) has a lock arm (31) that capable of coming into engagement with an engaged portion (26) fixed to the door leaf (2), and a link member (37) that has one end-side portion coupled rotatably to the lock arm (31). In this case, the connection portion between the lock arm (31) and the link member (37) may rotate until beyond the dead centre, which is the position where the straight line connecting the center of rotation of the lock arm (31) and the connection portion becomes flush with the straight line connecting the connection portion and the first section of the link member (37) other than the connection portion. It is also preferred that each of the lock mechanisms (5) further has a rotation preventing mechanism (9) that keeps the connection portion beyond the dead center by restricting movement of the first section.

The plug door lock device with this configuration is configured by a relatively small number of simple components, such as the motor, the lock arm, the link member, and the rotation preventing mechanism. Moreover, these components can be installed in a relatively narrow space in the vertical direction of the door leaf. Such a configuration, therefore, can provide the plug door lock device of a small, simple structure.

According to this configuration, the rotation preventing mechanism is provided to restrict the lock arm from rotating in the release direction. Such rotation of the lock arm can be restricted by use of force smaller than force that directly holds the lock arm. In other words, the engagement between the lock arm and the engaged portion can be held with small force.

Because the rotation preventing mechanism can keep the engagement between the lock arm and the engaged portion and restrict the movement of the door leaf in the opening direction and the separation direction, the safety of the door leaf can be improved.

(3) Also, it is preferred that the first section configure the other end of the link member (37). According to this configuration, the engagement between the lock arm and the engaged portion can be held with a smaller amount of force.

(4) It is more preferred that the lock device have a restricting portion that mechanically comes into contact with the first section to restrict a movement of the first section.

According to this configuration, the rotation of the lock arm can easily be restricted by the restricting portion that restricts the first section from moving toward the center of rotation of the lock arm.

(5) It is more preferred that the lock mechanisms (5) each have a rotary portion (61) that is provided with a guide portion (62) and rotated by the motor. In this case, the restricting portion is preferably moved linearly by the guide portion (62) of the rotary portion (61). Also, when the rotary portion (61) restricts a movement of the first section, the guide portion (62) preferably inhibits a linear motion of the restricting portion.

According to this configuration, the guide portion is configured to inhibit a movement of the restricting portion. Therefore, the rotation of the lock arm in the release direction can be restricted even when excessive force is applied to the lock arm and the like.

(6) It is more preferred that the restricting portion have a slider (41) and a movable portion (46) that can be coupled with or separated from the slider (41).

According to this configuration, the locking state of each of the lock mechanisms can be canceled manually in a case of emergency by disconnecting the slider and the movable portion from each other, thereby opening the door leaf.

Furthermore, a groove portion (44) may be formed in the slider (41). In this case, the restricting portion may have a coupling portion main body that is provided with a rod-like portion (53) and is capable of turning in such a manner that the rod-like portion (53) shifts from a state in which the rod-like portion (53) is fitted in the groove portion (44) to a state in which the rod-like portion (53) is separated from the groove portion (44).

In this configuration, the slider and the movable portion are coupled to each other by fitting the rod-like portion into the groove portion. On the other hand, the slider and the movable portion are disconnected from each other by separating the rod-like portion from the groove portion. The rod-like portion of the restricting portion is biased toward the groove portion while being fitted in the groove portion. Consequently, the movable portion can be coupled to the slider, while by releasing the biased rod-like portion from the groove portion, the movable portion can be separated from the slider.

(7) It is more preferred that an end portion of the slider (41) near the movable portion have an inclined surface (45) rising gradually away from the movable portion (46). The plug door lock device may have the rod-like portion (53) that is fitted in the groove portion (44) formed in the slider (41). When the movable portion (46), separated from the slider (41), moves toward the slider (41) as a result of separating the rod-like portion (53) from the groove portion (44), the rod-like portion (53) may move along the inclined surface (45) and then becomes fitted in the groove portion (44), thereby coupling the movable portion (46) and the slider (41) to each other.

According to this configuration, in a case where the rod-like portion is separated from the groove portion, and the slider and the movable portion are separated from each other, rotating the motor to move the movable portion toward the slider causes the rod-like portion to be fitted in the groove portion. In this manner, the slider and the movable portion can easily be coupled to each other.

(8) It is preferred that the lock device further have a motor control unit (7) that rotates and drives the motors (60) at different timings.

According to this configuration, the plurality of motors are driven at different times. Therefore, the power required and consumed at one time by the system for driving the plug door lock device can be reduced.

(9) It is preferred that the motor control unit (7) rotate and drive each of the motors (60) in a state in which the door leaf (2) is in contact with the vehicle by executing the plug operation.

According to this configuration, after the door leaf moves in the attachment direction to be attached to the vehicle, the lock mechanism can be brought into its locking state. This eliminates the need for the power for operating the door leaf in the attachment direction. Thus, the rating of the motors can be lowered.

(10) The plug door system has a door drive unit (3) for executing an opening/closing operation and a plug operation on the door leaf (2) provided in the vehicle, and the plug door lock device that causes the door drive unit (3) to lock the door leaf (2) in a closed state.

This configuration can provide a plug door system that has a plug door lock device capable of enhancing the safety of a plug door by a simplified structure.

In addition, the lock mechanisms each may have a sliding portion that is provided in such a manner as to be able to advance/retreat in an advancing direction to approach the center of rotation of the lock arm and a retreating direction to separate from the center of rotation. A first guide portion, which is provided as a groove or through-hole in the shape of an elongated hole in which a first projection provided on the other end of the link member can slide along the advancing direction and the retreating direction, may be formed in the sliding portion. The sliding portion may move in the retreating direction as the electric motor rotates, so one end of the first guide portion in the vicinity of the center of rotation of the lock arm comes into contact with the first projection. In this case, when the lock arm is pressed by the engaged portion and thereby rotates in a predetermined direction as a result of the movement of the door leaf towards being attached to the doorway, the first projection may move along the first guide portion, whereby the connection portion between the lock arm and the link member may rotate until beyond the dead centre where the straight line connecting the center of rotation of the lock arm and the connection portion becomes flush with the straight line connecting the connection portion and the first projection. Each of the lock mechanisms may further have a rotation preventing mechanism that restricts the lock arm from being rotated in a direction opposite to the predetermined direction by force that acts on the lock arm in the opposite direction when the connection portion of the lock arm is in a position beyond the dead centre.

The rotation preventing mechanism may be configured to restrict the first projection from moving in the advancing direction, by adjusting the position of the sliding portion so that the first projection comes into contact with the one end of the first guide portion when the connection portion is located beyond the dead centre.

The lock mechanisms may each have a rotary portion that is rotated by the corresponding electric motor. In this case, the rotation preventing mechanism may have a second projection formed in the sliding portion, and a second guide portion that is provided in the rotary portion as a groove or through-hole in the shape of an elongated hole in which the second projection can slide, causes the second projection to advance and retreat in the advancing direction and the retreating direction as the rotary portion rotates, and restricts the rotary portion from being rotated by force acting on the sliding portion in the advancing direction.

According to this configuration, even when, for example, a passenger applies external force to the lock arm in the release direction by forcibly opening the door leaf, and consequently the sliding portion is pulled in the advancing direction by the first projection, the second projection and the second guide portion restrict the rotary portion from rotating. Consequently, the lock arm can be prevented from rotating in the release direction. In other words, according to this configuration, the rotation preventing mechanism can be configured by relatively simple components such as the second projection and the second guide portion.

The rotary portion may have a plurality of teeth that come into mesh with a gear fixed to an axis of rotation of the motor.

According to this configuration, the ratio between the number of teeth of the gear fixed to the axis of rotation of the motor and the number of teeth of the rotary portion is set at a desired value, so a desired reduction gear ratio can be obtained.

The axis of rotation of the motor may be coupled to the center of rotation of the rotary portion.

According to this configuration, the rotary portion can be rotated directly (i.e., without using a plurality of gears) by the axis of rotation of the motor, simplifying the configuration of each lock mechanism.

Furthermore, this plug door lock device is a plug door lock device that is installed in a doorway of a vehicle and locks, to the vehicle, a door leaf that executes an opening/closing operation for opening/closing the doorway by moving in a front-back direction of the vehicle and a plug operation for coming into contact with or separating from the doorway by moving in a width direction of the vehicle, the door lock device having: an electric motor provided in the vehicle; a lock arm that is provided so as to be rotatable with respect to the vehicle about a center of rotation thereof and is rotated by a driving force of the electric motor to come into engagement with an engaged portion that is fixed to the door leaf that is moved towards being attached to the doorway; a link member having one end thereof coupled rotatably to the lock arm; and a sliding portion that is provided so as to be able to advance in an advancing direction to approach the center of rotation of the lock arm and to retreat in a retreating direction to separate from the center of rotation, has a first guide portion provided as a groove or through-hole in the shape an elongated hole in which a first projection provided at the other end of the link member can slide along the advancing direction and the retreating direction, and brings one end of the first guide portion in the vicinity of the center of rotation of the lock arm into contact with the first projection by moving in the retreating direction as the electric motor rotates. When the lock arm is pressed by the engaged portion and thereby rotates in a predetermined direction as a result of the movement of the door leaf towards being attached to the doorway, the first projection moves along the first guide portion, whereby the connection portion between the lock arm and the link member rotates until beyond the dead centre where the straight line connecting the center of rotation of the lock arm and the connection portion becomes flush with the straight line connecting the connection portion and the first projection. The plug door lock device further has a rotation preventing mechanism that restricts the lock arm from being rotated in a direction opposite to the predetermined direction by force that acts on the lock arm in this opposite direction when the connection portion is located beyond the dead centre.

As disclosed in Japanese Unexamined Patent Publication No. H06-262945, for example, the conventional plug door lock device is large and has a relatively complicated structure. Specifically, the plug door lock device disclosed in Japanese Unexamined Patent Publication No. H06-262945 is large in the vertical direction because the screw shaft for moving the lock arm in the vertical direction extends in the vertical direction, as shown in FIG. 2 and the like. Moreover, the receiving member that is formed on the door leaf side so that the lock arm comes into engagement therewith has a complicated concave shape.

An object of a plug door lock device according to another aspect of the present invention is to provide a plug door lock device of a small, simplified structure.

The plug door lock device according to this aspect is configured by a relatively small number of simple components such as an electric motor, a lock arm, a link member, a sliding portion, a link portion, and a rotation preventing mechanism. Moreover, these components can be installed in a relatively narrow space of the door leaf in the vertical direction. This configuration, therefore, can realize a plug door lock device of a small, simplified structure.

The plug door lock device according to this aspect, can be limited by the matters described in (2) to (10) above.

Thus, the effects same as those described above can be accomplished.

A plug door system according to another aspect has a door leaf, a door drive unit for driving the door leaf to cause the door leaf to execute an opening/closing operation and a plug operation, and the plug door lock device according to any of the other aspects described above.

The plug door system according to this aspect can provide a plug door system that has a plug door lock device of a small, simplified structure.

The present invention can be widely applied to a plug door lock device for locking a plug door to a vehicle, and a plug door system having this device.

This application is based on Japanese Patent application No. 2013-269402 filed in Japan Patent Office on Dec. 26, 2013, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A plug door lock device to be installed in a vehicle, the plug door lock device comprising:

a plurality of lock mechanisms, each having a motor for locking a door leaf with respect to the vehicle, the door leaf configured to execute an opening and closing operation for opening and closing a doorway by moving in a front-back direction of the vehicle and a plug operation for coming into contact with and separating from the vehicle by moving in a width direction of the vehicle, wherein each of the plurality of lock mechanisms includes a lock arm configured to come into engagement with an engaged portion fixed to the door leaf, and a link member having a first end rotatably coupled to the lock arm and being pivotable about a first section of the link member, the first section being a portion of the link member other than a connection portion connecting the lock arm and the link member, wherein the connection portion is configured to rotate from a first position when the door leaf is in an opened state to a second position beyond a dead center position when the door leaf is in a closed state, the dead center position being a position at which a first straight line connecting a center of rotation of the lock arm and the connection portion becomes flush with a second straight line connecting the connection portion and the first section of the link member and at which the connection portion, the first section of the link member and the center of rotation of the lock arm are arranged in this order, the first position being a position at which the connection portion is apart from a third straight line connecting the center of rotation of the lock arm and the first section of the link member, the second position being opposite to the first position with respect to the third straight line and being a position at which the connection portion is apart from the third straight line, and wherein each of the plurality of lock mechanisms has a rotation preventing mechanism that keeps the connection portion beyond the dead center position by restricting a movement of the first section of the link member to a direction that is perpendicular to the front-back direction of the vehicle and that passes through the center of rotation of the lock arm.

2. The plug door lock device according to claim 1, wherein the first section configures a second end of the link member.

3. The plug door lock device according to claim 1, further comprising a motor control unit that is configured to rotate and drive the motors at different timings.

4. The plug door lock device according to claim 3, wherein the motor control unit is configured to rotate and drive the motors in a state in which the door leaf is in contact with the vehicle.

5. The plug door lock device according to claim 1, wherein the lock arm comprises a body with a first end portion and a second end portion, wherein the second end portion of the lock arm includes an engagement portion that is configured to come into engagement with the engaged portion fixed to the door leaf, and wherein the center of rotation of the lock arm is on the body thereof, and the engagement portion being spaced from the center of rotation of the lock arm to pivot in the same direction as the body about the center of rotation.

6. The plug door lock device according to claim 1, wherein each of the plurality of lock mechanisms further includes a base plate, wherein the lock arm includes a coupling portion that is configured to rotatably couple the lock arm and the base plate, the coupling portion of the lock arm forming the center of rotation of the lock arm, and wherein a position of the center of the rotation of the lock arm remains the same with respect to the base plate both when the door leaf is in the closed state and is in the opened state.

7. A plug door system, comprising:

a door drive unit that causes a door leaf provided in a vehicle to execute an opening and closing operation and a plug operation; and a plug door lock device according to claim 1, the plug door lock device being for locking the door leaf in a closed state by means of the door drive unit, wherein the plug door lock device is provided with the plurality of lock mechanisms.

8. A plug door lock device to be installed in a vehicle, the plug door lock device comprising:

a plurality of lock mechanisms, each having a motor for locking a door leaf with respect to the vehicle, the door leaf configured to execute an opening and closing operation for opening and closing a doorway by moving in a front-back direction of the vehicle and a plug operation for coming into contact with and separating from the vehicle by moving in a width direction of the vehicle;

wherein each of the plurality of lock mechanisms includes a lock arm configured to come into engagement with an engaged portion fixed to the door leaf, and a link member having a first end rotatably coupled to the lock arm and being pivotable about a first section of the link member, the first section being a portion of the link member other than a connection portion connecting the lock arm and the link member, wherein the connection portion is configured to rotate from a first position when the door leaf is in an opened state to a second position beyond a dead center position when the door leaf is in a closed state, the dead center position being a position at which a first straight line connecting a center of rotation of the lock arm and the connection portion becomes flush with a second straight line connecting the connection portion and the first section of the link member, the first position being a position at which the connection portion is apart from a third straight line connecting the center of rotation of the lock arm and the first section of the link member, the second position being opposite to the first position with respect to the third straight line and being a position at which the connection portion is apart from the third straight line, and wherein each of the plurality of lock mechanisms has a rotation preventing mechanism that keeps the connection portion beyond the dead center position by restricting a movement of the first section of the link member, wherein the plug door lock device further comprising a restricting portion configured to restrict the movement of the first section by mechanically coming into contact with the first section, wherein the plurality of lock mechanisms each have a rotary portion that is provided with a guide portion and rotated by the motor, wherein the restricting portion is moved linearly by the guide portion of the rotary portion, and wherein the guide portion is configured to inhibit a linear motion of the restricting portion when the rotary portion restricts a movement of the first section.

9. A plug door lock device to be installed in a vehicle, the plug door lock device comprising:

a plurality of lock mechanisms, each having a motor for locking a door leaf with respect to the vehicle, the door leaf configured to execute an opening and closing operation for opening and closing a doorway by moving in a front-back direction of the vehicle and a plug operation for coming into contact with and separating from the vehicle by moving in a width direction of the vehicle;

wherein each of the plurality of lock mechanisms includes a lock arm configured to come into engagement with an engaged portion fixed to the door leaf, and a link member having a first end rotatably coupled to the lock arm and being pivotable about a first section of the link member, the first section being a portion of the link member other than a connection portion connecting the lock arm and the link member, wherein the connection portion is configured to rotate from a first position when the door leaf is in an opened state to a second position beyond a dead center position when the door leaf is in a closed state, the dead center position being a position at which a first straight line connecting a center of rotation of the lock arm and the connection portion becomes flush with a second straight line connecting the connection portion and the first section of the link member, the first position being a position at which the connection portion is apart from a third straight line connecting the center of rotation of the lock arm and the first section of the link member, the second position being opposite to the first position with respect to the third straight line and being a position at which the connection portion is apart from the third straight line, and wherein each of the plurality of lock mechanisms has a rotation preventing mechanism that keeps the connection portion beyond the dead center position by restricting a movement of the first section of the link member, wherein the plug door lock device further comprising a restricting portion configured to restrict the movement of the first section by mechanically coming into contact with the first section, wherein the restricting portion has a slider and a movable portion that is configured to be coupled to and released from the slider.

10. The plug door lock device according to claim 9, wherein an inclined surface that rises gradually away from the movable portion Is formed at an end portion of the slider close to the movable portion, wherein the restricting portion further has a coupling link for coupling the slider and the movable portion to each other, the coupling link being configured for rotating with respect to the movable portion, the coupling link being provided with a rod portion that is fitted in a groove portion formed in the slider, and wherein, when the motor rotates to move the movable portion toward the slider, the rod portion moves along the inclined surface and then fits into the groove portion, whereby the movable portion and the slider are coupled to each other so as to cancel a manually operating state of the lock mechanism.

* * * * *